US007042478B2

(12) United States Patent
Bouverie et al.

(10) Patent No.: US 7,042,478 B2
(45) Date of Patent: May 9, 2006

(54) MODULAR PRINTER

(75) Inventors: William M. Bouverie, Windermere, FL (US); Kenneth Colonel, Oviedo, FL (US); Christopher Roy Christensen, Gotha, FL (US); Dwayne Tobin, Longwood, FL (US); Jay Huberty, Gotha, FL (US); Ron Consiglio, Clermont, FL (US); Fred Scofield, Orlando, FL (US); Mark Hitz, Lake Mary, FL (US); George Vazac, Apopka, FL (US); Richard Hatle, Oviedo, FL (US)

(73) Assignee: Datamax Corporation, Orlando, FL (US)

( * ) Notice: Subject to any disclaimer, the term of this patent is extended or adjusted under 35 U.S.C. 154(b) by 111 days.

(21) Appl. No.: 10/668,943

(22) Filed: Sep. 22, 2003

(65) Prior Publication Data

US 2004/0114024 A1 Jun. 17, 2004

Related U.S. Application Data

(63) Continuation-in-part of application No. 10/634,000, filed on Aug. 4, 2003, now Pat. No. 6,846,121, which is a continuation of application No. 09/965,533, filed on Sep. 26, 2001, now Pat. No. 6,616,362, which is a continuation of application No. pct/us00/08051, filed on Mar. 27, 2000.

(60) Provisional application No. 60/126,499, filed on Mar. 26, 1999, provisional application No. 60/412,481, filed on Sep. 20, 2002.

(51) Int. Cl.
*B41J 11/00* (2006.01)

(52) U.S. Cl. ..... 347/177

(58) Field of Classification Search ..... 347/177, 347/197, 215, 217, 219; 400/234, 249
See application file for complete search history.

(56) References Cited

U.S. PATENT DOCUMENTS

| | | | | |
|---|---|---|---|---|
| 4,019,935 | A | 4/1977 | Harvey | |
| 4,732,502 | A | 3/1988 | Yokoi | |
| 4,776,714 | A | 10/1988 | Sugiura et al. | |
| 4,795,281 | A | 1/1989 | Ulinski, Sr. et al. | |
| 5,067,832 | A | 11/1991 | Baur et al. | |
| 5,103,259 | A | 4/1992 | Saitoh et al. | |
| 5,195,837 | A | 3/1993 | Steppe et al. | |
| 5,320,437 | A | 6/1994 | Malke et al. | |
| 5,344,248 | A | 9/1994 | Schoon et al. | |
| 5,438,349 | A | 8/1995 | Fox et al. | |
| 5,501,537 | A * | 3/1996 | Kohno | 400/240.4 |

(Continued)

FOREIGN PATENT DOCUMENTS

DE 2802104 B1 1/1978

(Continued)

*Primary Examiner*—K. Feggins
(74) *Attorney, Agent, or Firm*—Carter, DeLuca, Farrell & Schmidt, LLP

(57) ABSTRACT

A modular printer having a media take-up assembly, a support block assembly, a printhead assembly, a stepper motor assembly and a display assembly is provided. A support housing having a plurality of recesses formed on an internal wall of the modular printer is also provided. Each of the recesses is configured to receive and align one of the modular printer assemblies with the other modular printer assemblies. Each of the assemblies is configured as a module which can be easily accessed and quickly secured to or detached from the support housing. The support housing is adapted to receive assembly modules for both thermal ink printers and ribbon ink printers such that the modular printer can be easily converted from one to the other.

14 Claims, 23 Drawing Sheets

U.S. PATENT DOCUMENTS

| | | | |
|---|---|---|---|
| 5,507,583 | A | 4/1996 | Beaty et al. |
| 5,534,890 | A | 7/1996 | Krug et al. |
| 5,563,686 | A | 10/1996 | Beaufort et al. |
| 5,564,845 | A | 10/1996 | Yamaguchi et al. |
| 5,570,962 | A | 11/1996 | Suzuki et al. |
| 5,587,728 | A | 12/1996 | Edgar |
| 5,588,761 | A | 12/1996 | Seib |
| 5,613,790 | A | 3/1997 | Miazga |
| 5,619,240 | A | 4/1997 | Pong et al. |
| 5,650,730 | A | 7/1997 | Herbst, Jr. |
| 5,707,162 | A | 1/1998 | Kasai et al. |
| 5,802,973 | A | 9/1998 | Mueller et al. |
| 5,820,279 | A | 10/1998 | Lodwig et al. |
| 6,030,133 | A | 2/2000 | Endo |
| 6,231,253 | B1 | 5/2001 | Henderson et al. |
| 6,396,070 | B1 | 5/2002 | Christensen et al. |
| 6,412,991 | B1 * | 7/2002 | Klinefelter et al. ..... 400/240 |
| 6,616,362 | B1 | 9/2003 | Bouverie et al. |

FOREIGN PATENT DOCUMENTS

| | | | |
|---|---|---|---|
| EP | 0195949 | A2 | 2/1986 |
| EP | 0798122 | A2 | 1/1997 |

* cited by examiner

MODULAR PRINTER

This application is a continuation-in-part of U.S. application Ser. No. 10/634,000, filed Aug. 4, 2003, now U.S. Pat. No. 6,846,121, which is a continuation of U.S. application Ser. No. 09/965,533, filed Sep. 26, 2001, now U.S. Pat. No. 6,616,362, which is a continuation of PCT Application No. PCT/US00/08051, filed Mar. 27, 2000, which claims priority from U.S. Provisional Application Ser. No. 60/126,499, filed on Mar. 26, 1999. This application also claims priority from U.S. Provisional Application Ser. No. 60/412,481, filed Sep. 20, 2002 which is incorporated herein by reference in its entirety.

BACKGROUND

1. Technical Field

The present disclosure relates to printers in general and more particularly to a modular printer assembly having components configured as modules which can be easily and quickly removed and/or secured to the assembly to perform basic maintenance and/or convert the printer assembly from a thermal ink printer to a ribbon ink printer.

2. Background of Related Art

Thermal ink printers and ribbon ink printers are well known and widely used. These printers include a variety of complex components enclosed within a housing. Typically, the components are arranged in such a manner that it is difficult to access any one or all of the components to perform basic maintenance and repair. Thus, operational downtime to perform basic repairs and maintenance is prolonged and reliance on the availability of a service technician to maintain a printer operational is assured.

Conventional printers, as mentioned briefly above, include both thermal ink printers and ribbon ink printers. Thermal ink printers and ink ribbon printers include a majority of common components. Despite this fact, if an operator required or desired both a thermal ink printer and an ink ribbon printer, the operator would have to purchase two separate units at increased expense.

Accordingly, a need exists for a printer which is capable of operating as both a thermal ink printer and a ribbon ink printer. Moreover, a need exists for an improved, less complex printer having easily accessible internal components which facilitate speedy maintenance and repair by a service technician and/or the printer operator.

SUMMARY OF THE INVENTION

In accordance with the present disclosure, a modular printer having a support housing is provided. The modular printer includes a media take-up assembly, a support block assembly, a printhead assembly, a media sensor assembly, a drive motor assembly, a cover assembly and a display assembly. Electrical circuitry in the form of circuit boards is provided to provide power where required. The support housing defines an internal support wall having a plurality of recesses formed therein. Each recess is configured to receive one of the modular printer assemblies. Each assembly defines a separate module which can be independently secured to or removed from the support wall. The printing assemblies or modules are secured to one side of the support wall and the electric motor assembly and circuitry are secured to the opposite side of the support wall. Such a modular printer has been disclosed in U.S. patent application Ser. No. 09/965,533, filed Sep. 26, 2001, now U.S. Pat. No. 6,616,362, the contents of which is hereby incorporated herein by reference in its entirety.

The modular printer disclosed herein allows for easy access to each of the printer components for repair and/or maintenance. Moreover, the modular configuration facilitates printer upgrading, i.e., conversion from a thermal ink printer to a ribbon ink printer.

BRIEF DESCRIPTION OF THE DRAWINGS

Various preferred embodiments of the presently disclosed printer are described herein with reference to the drawings wherein.

DETAILED DESCRIPTION OF PREFERRED EMBODIMENTS

Figure 1:
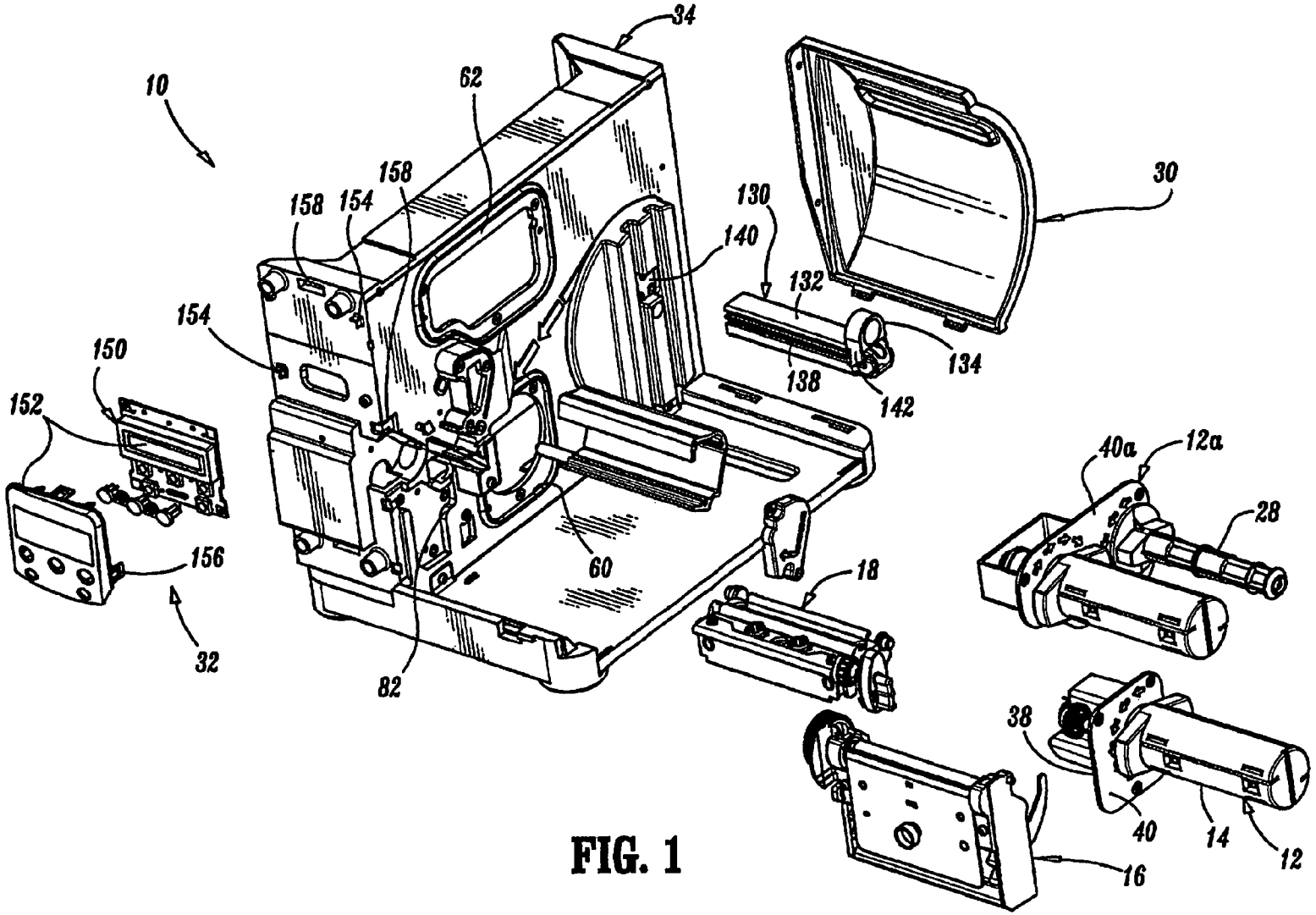
FIG. 1 is a perspective view with parts separated of one embodiment of the presently disclosed modular printer.

Preferred embodiments of the presently disclosed modular thermal printer will now be described in detail with reference to the drawings, in which like reference numerals designate identical or corresponding elements in each of the several views.

Figure 2:
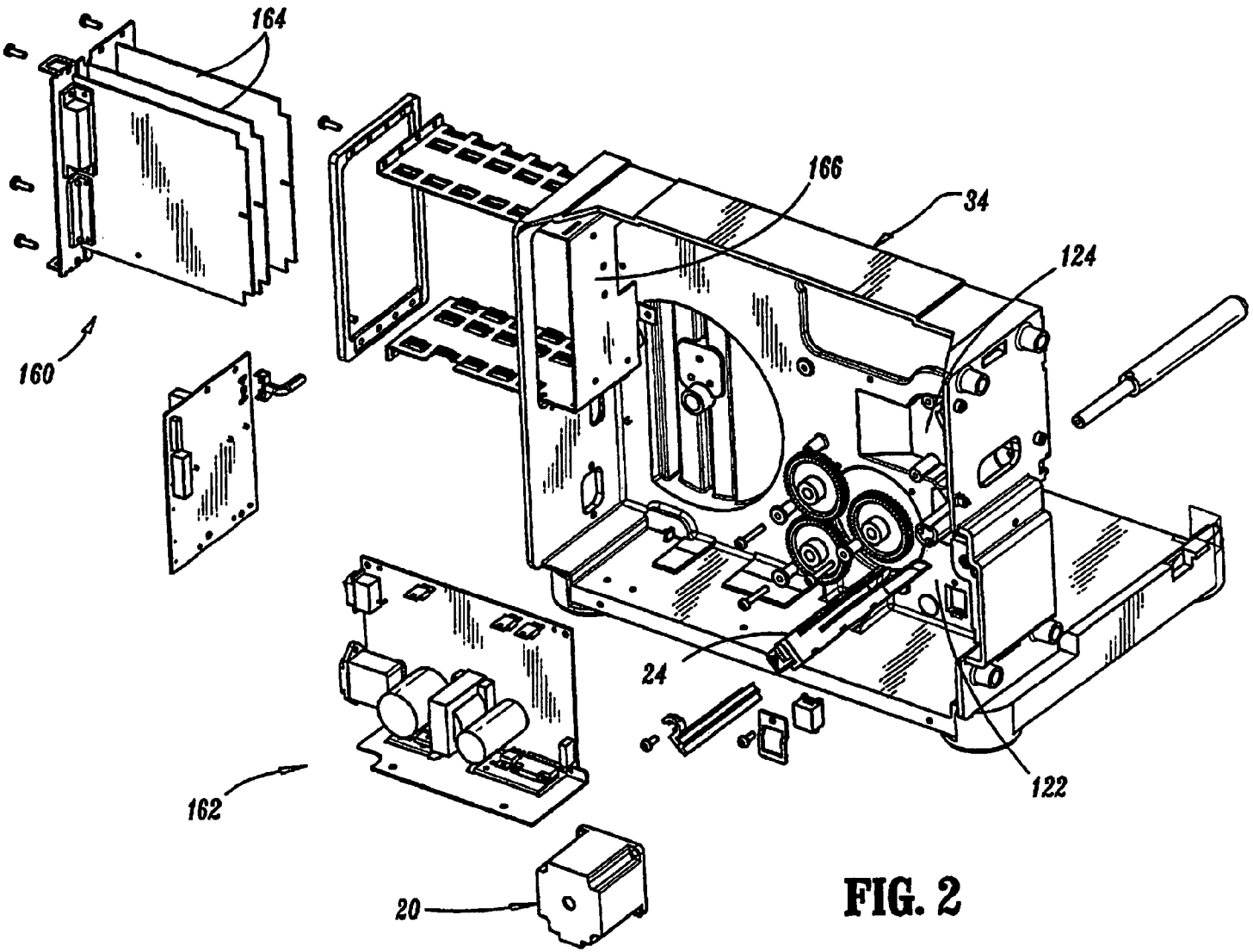
FIG. 2 is a perspective view with parts separated of the electrical and drive components of the modular printer shown in FIG. 1.

FIGS. 1 and 2 illustrate perspective views of the modular printer, with parts separated, shown generally as 10. More specifically, FIG. 1 illustrates the printing components of the modular printer and FIG. 2 illustrates the electrical and drive components of the modular printer.

Briefly, modular ink printer 10 includes a media take-up assembly 12 including a hub assembly 14 configured to support a media take-up roll (not shown), a support block assembly 16, a printhead assembly 18, a stepper motor assembly 20, a media sensor assembly 24, a cover assembly 30 and a display assembly 32. When printer 10 is operated as a ribbon ink printer, a ribbon spool take-up assembly 28 may also be provided in conjunction with the media take-up assembly. Each of the above-identified assemblies are removably supported on a support housing 34 having a plurality of recesses, which will be discussed in further detail below. The support housing defines an internal support wall of the modular printer and is configured for properly aligning each of the assemblies with respect to each of the other assemblies within the printer. Support housing 34 is preferably formed from a heat conductive material, such as an aluminum support housing, to facilitate the removal of heat from printer 10. However, other materials may also be used to form housing 34 including ceramics, plastics, sheet metal etc.

As discussed above, printer 10 has a display assembly 32. Display assembly 32 includes a module 150 having an LED display and a casing 152. Module 150 is positioned between diametrically opposed guide brackets 154 formed on support housing 34. Opposite corners of module 150 are subsequently secured to support housing 34 by screws. Casing 152 includes a plurality of flexible brackets 156 which can be snap fit to support housing 34 over module 150. Support housing 34 includes receiving structure 158 formed therein. Alternately, other known fastening devices may be used to secure module 150 and casing 152 to support housing 34.

Referring again to FIG. 2, the electrical and drive components of the ink printer 10 are secured to the opposite side of support housing 34 than are the printing components of the ink printer 10. As discussed above, stepper motor assembly 20 is secured to support housing 34 on the side opposite the printing components. Electronic circuitry 160 and electric drive assembly 162 to operate ink printer are secured to the support housing 34 on the side opposite the printing components. Electronic circuitry 160 is in the form of circuit boards 164, which can be installed in printer 10 by sliding the circuit boards through an opening 166, formed in support housing 34. The circuit boards can be chosen to suit the particular printing operation to be performed. For example, the circuitry 160 can be changed for different communications interfaces. Alternatively, software can be downloaded via a comport to control a particular printing application.

Figure 3:
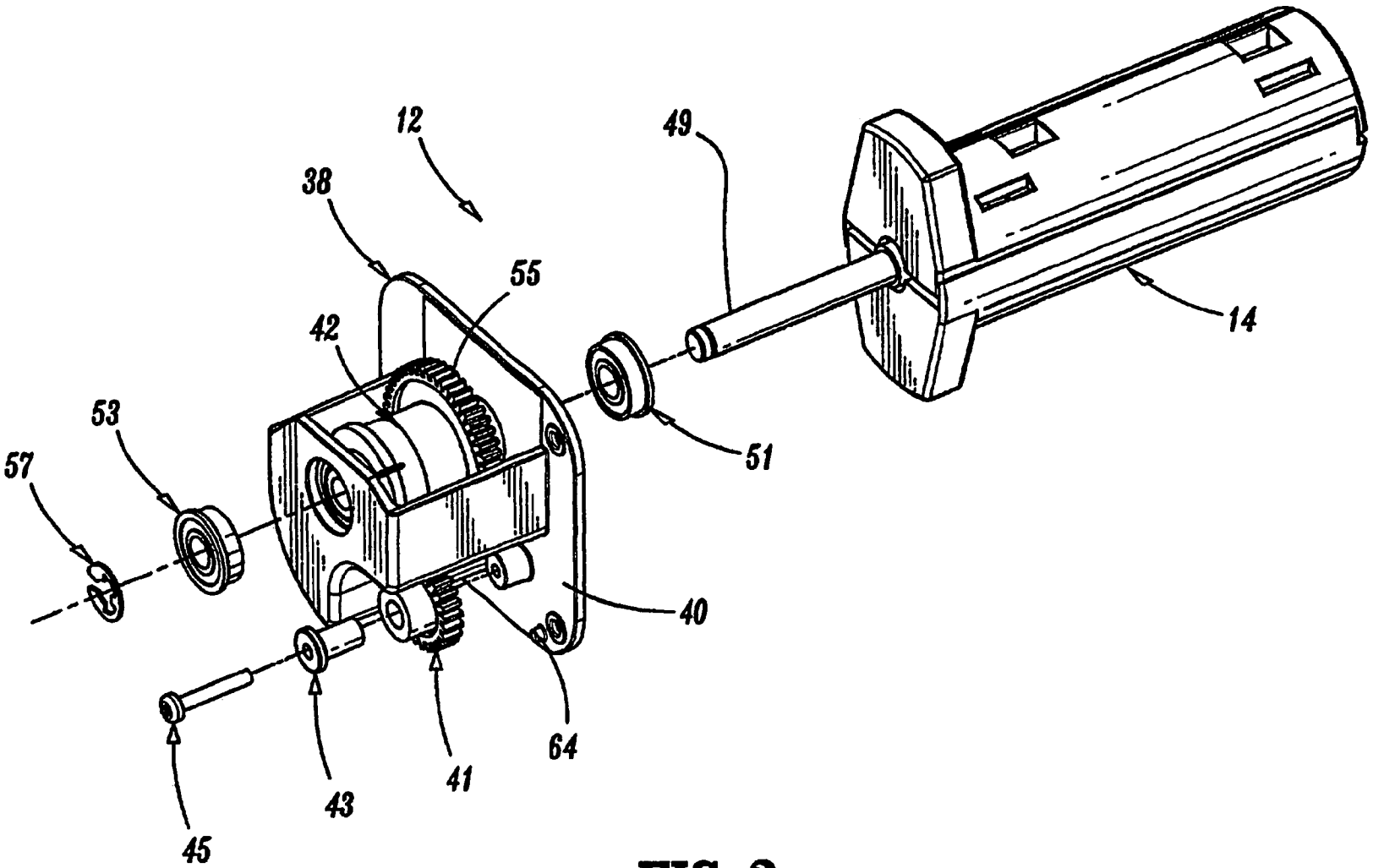
FIG. 3 is a perspective view with parts separated of the media take-up assembly of the modular printer shown in FIG. 1 when the printer is operated as a thermal ink printer.

Referring to FIG. 3, where printer 10 operated as a thermal ink printer, media take-up assembly 12 includes hub assembly 14, a housing 38 having a base plate 40 and a media clutch assembly 42 supported within housing 38. Media take-up assembly 12 also includes a gear 41, a post idler 43, and a screw 45 for securing gear 41 and post idler 43 to housing 38. First end 49 is supported by bearings 51 and 53. Bearing 51 is supported in driven gear 55 and bearing 53 is supported by housing 38. A lock ring 57 secures bearings 51 and 53, gear 55 and media clutch assembly 42 to shaft 46.

Figure 4:
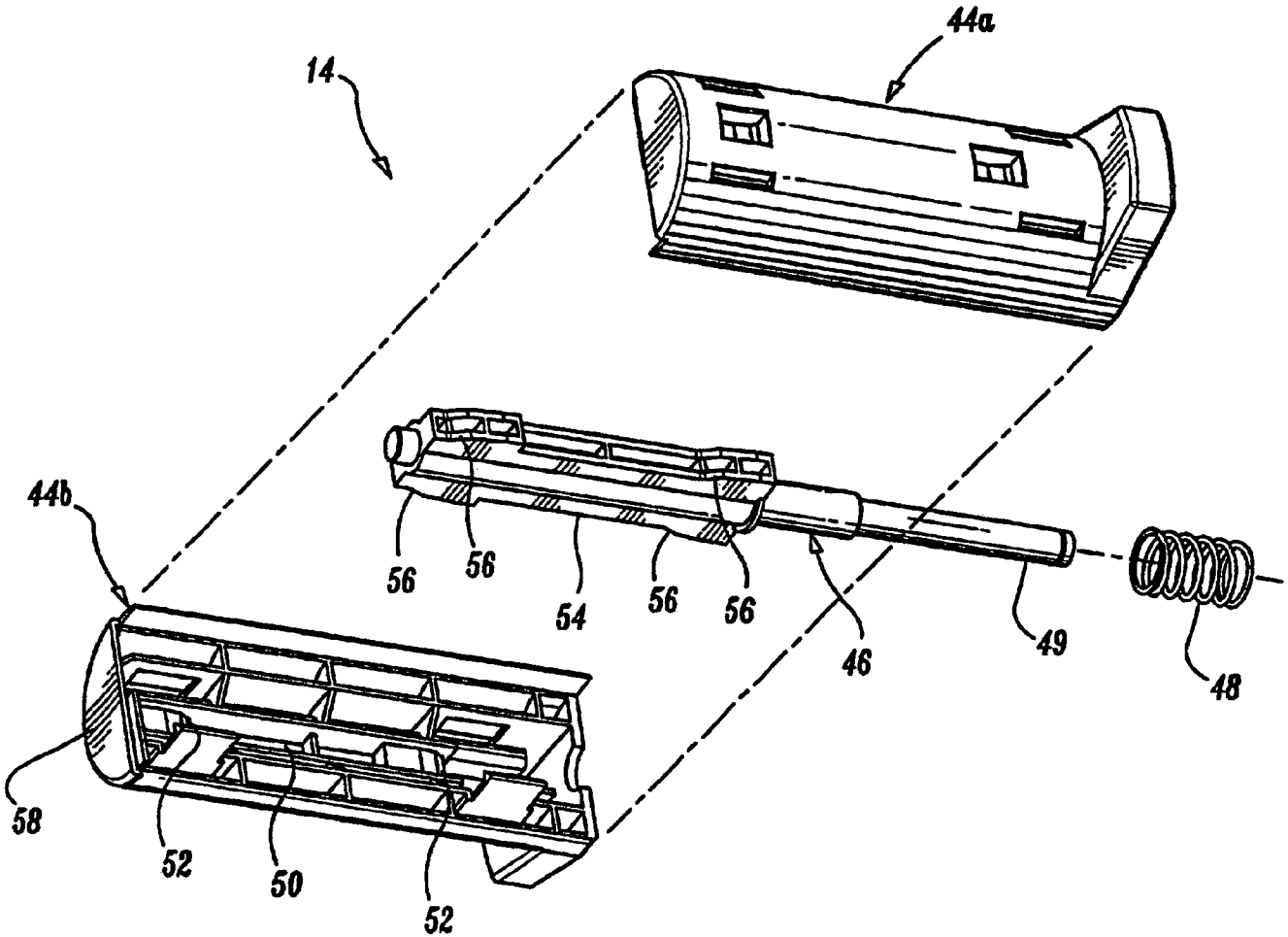
FIG. 4 is a perspective view with parts separated of the hub assembly of the media take-up assembly shown in FIG. 3.

Referring also to FIG. 4, hub assembly 14 includes a pair of molded housing half-sections 44*a* and 44*b*, which define hub assembly housing 44, a hub shaft 46 and a biasing member, which is preferably a coil spring 48. Hub shaft 46 includes a first end 49 having a reduced diameter, which extends outwardly from hub assembly housing 44.

Hub assembly housing half-sections 44*a* and 44*b* define a channel 50 having a pair of cam surfaces 52 formed therein. An engagement member 54 is secured to or formed monolithically with hub shaft 46. Each side of engagement member 54 includes a pair of abutment surfaces 56. Alternately, abutment surfaces may only be provided on one side of engagement member 54.

In the assembled state, engagement member 54 of hub shaft 46 is slidably positioned within channel 50 with coil spring 48 urging hub shaft 46 towards the distal end 58 of housing 44. Abutment surfaces 56 are positioned adjacent but distal of respective cam surfaces 52. When it is desired to remove a media take-up roll from and/or position a media take-up roll onto hub assembly 14, housing half-sections 44*a* and 44*b* are pulled outward to force cam surfaces 52 into engagement with abutment surfaces 56. Because surfaces 52 and 56 are angled towards distal end 58, compression of the housing half-sections urges hub shaft 46 against the bias of spring 48 away from distal end 58 of housing 44 allowing housing half-sections 44*a* and 44*b* to move towards each other to facilitate installation or removal of a media take-up roll onto or from hub assembly 14.

Referring again to FIGS. 1 and 3, the entire media take-up assembly 12 including hub assembly 14, housing 38 and media clutch assembly 42 forms an integral unit or module. Support housing 34 includes a plurality of reliefs formed on an internal wall of modular printer 10. One such relief 60 is configured to receive baseplate 40 of housing 38 and includes an alignment port 62 formed therein dimensioned to receive an alignment protrusion 64 formed on baseplate 40 to ensure proper positioning of media take-up assembly 12 on support housing 34. Only three screws are required to secure the entire media take-up assembly 12 to support housing 34, thus the entire assembly or module can be easily removed from or installed within printer 10.

Figure 5:
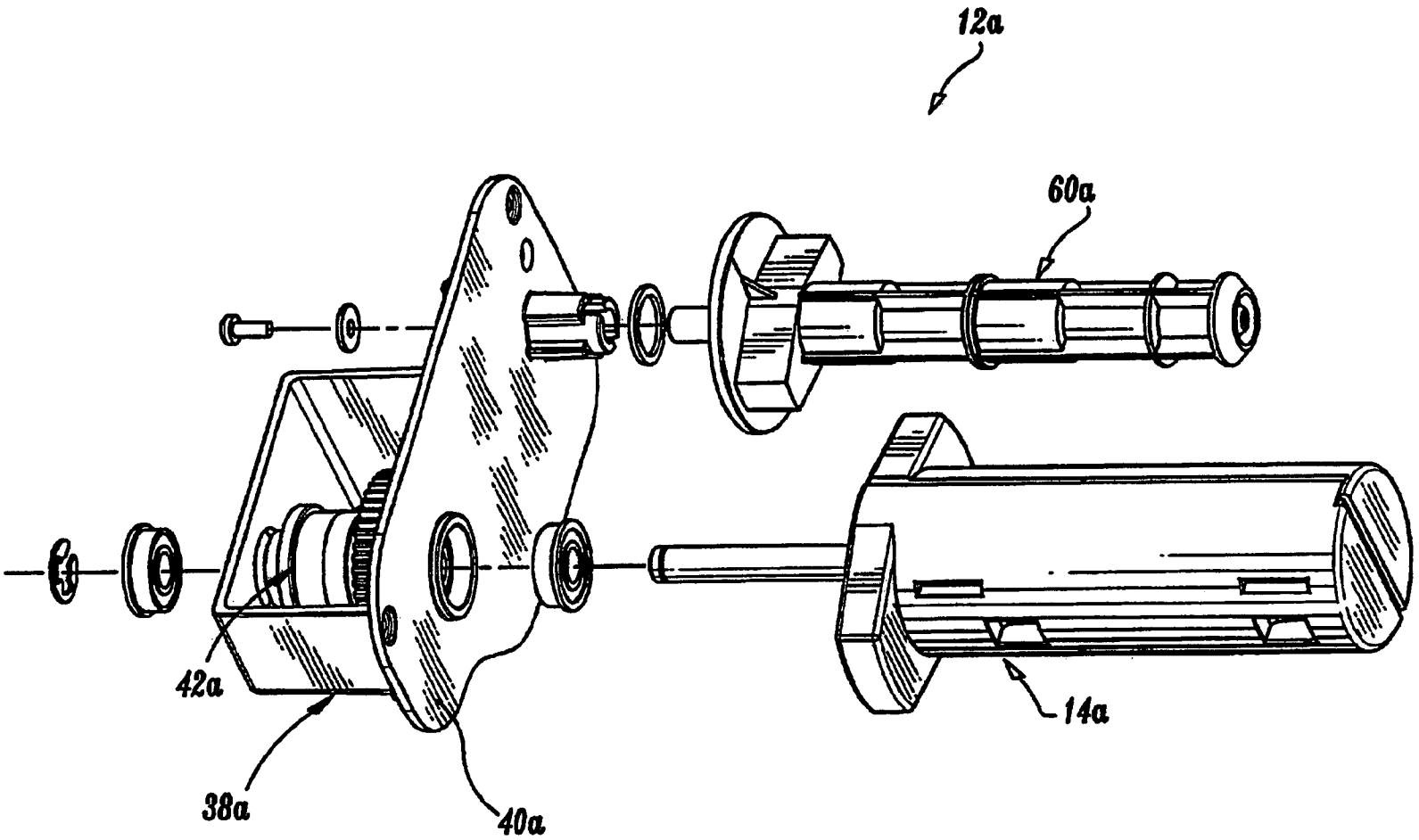
FIG. 5 is a perspective view of the ribbon take-up assembly of the modular printer shown in FIG. 1 when the printer is operated as an ink ribbon printer.

Referring to FIG. 5, where printer 10 is operated as an ink ribbon printer, a second media take-up assembly 12*a* is provided which in addition to hub assembly 14*a*, housing 38*a* including baseplate 40*a*, and media clutch assembly 42*a*, includes a ribbon supply assembly 60*a*. Ribbon supply assembly 60*a* is also secured to baseplate 38*a* such that the media take-up assembly 14*a* forms an integral unit or module.

Referring again to FIGS. 1 and 5, a relief 62 configured to receive baseplate 40*a* is formed in support housing 34. As discussed above with respect to relief 60, an alignment port (not shown) is formed in relief 62 to ensure proper positioning of media take-up assembly 12*a* within relief 62. Baseplate 40*a* can be secured to support housing 34 using three screws, thus facilitating fast and easy removal and/or installation of media take-up assembly 12*a* within printer 10.

Since printer 10 can only be operated as either a thermal ink printer or an ink ribbon printer, either or both of media take-up assemblies 12 or 12*a* will be secured to support housing 34 at a time. However, the printer 10 can be easily and quickly converted from a thermal ink printer to a ribbon ink printer and vice-versa by substituting one media take-up assembly or module for the other. The relief configured to receive the baseplate of the media take-up assembly not in use should be covered by a blank (not shown), which is preferably constructed of the material used to form support housing 34.

Figure 6:
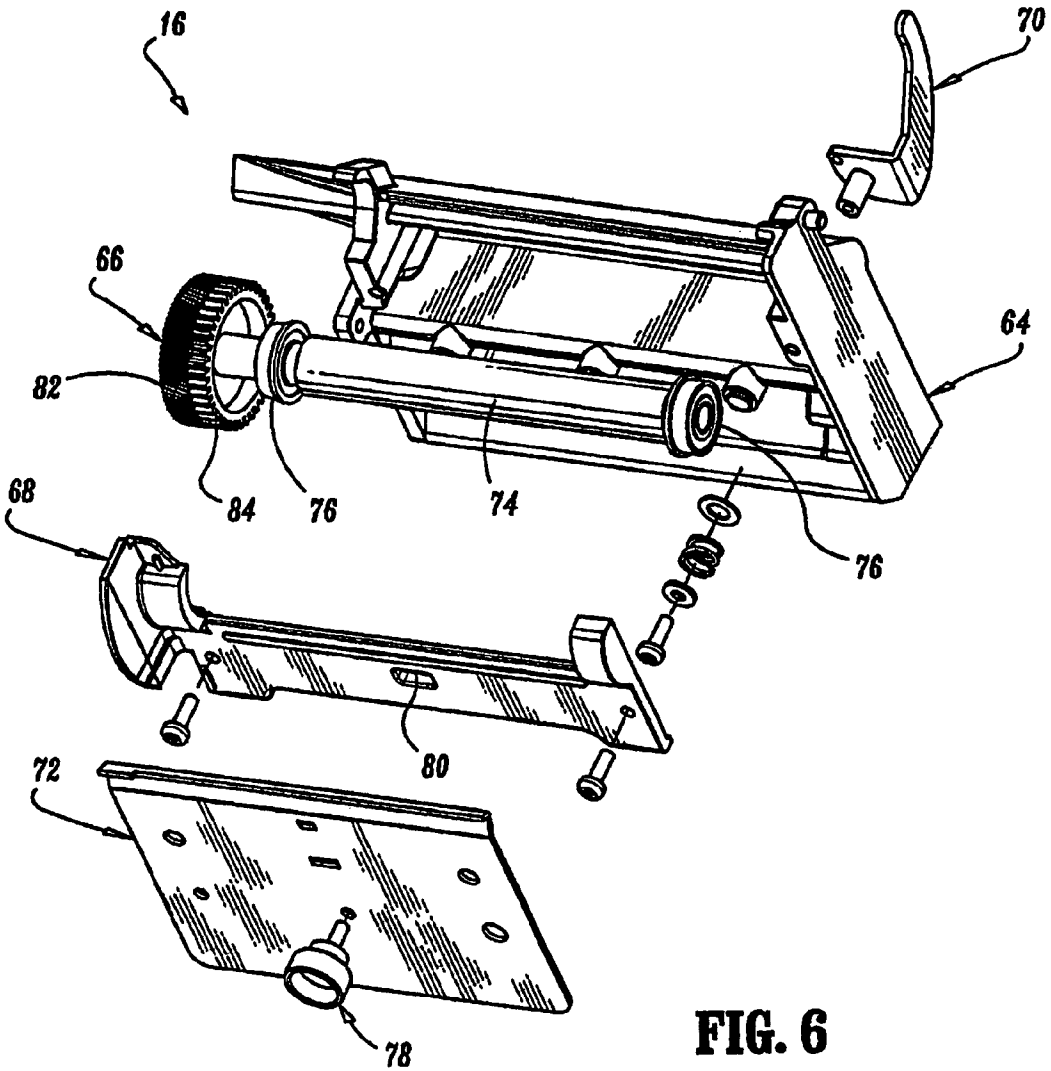
FIG. 6 is a perspective view with parts separated of the support block assembly of the modular printer shown in FIG. 1.

Referring to FIGS. 1 and 6, support block assembly 16 includes platen mounting block 64, a platen assembly 66, a retainer bracket 68, a media guide 70, and a tear bar 72. Platen assembly 66 includes platen 74 having a shaft (not shown) rotatably supported on mounting block 64. A flanged bearing 76 is secured to each end of the platen shaft. The bearings are positioned within recesses (not shown) formed in mounting block 64 to facilitate rotation of platen 74 relative to mounting block 64. A pair of driven gears 82 and 84 are secured to one end of the platen shaft and are independently engageable by a drive gear (which will be discussed below) to drive the platen 74. Retainer bracket 68 is secured to mounting block 64 via a pair of screws to retain bearings 76 within the recesses of mounting block 64. Tear bar 72 is secured to mounting block 64 by a screw 78 which extends through an opening 80 defined by retainer bracket 68.

It is noted that in printers found in the prior art, removal of a damaged platen is a difficult, time-consuming procedure. In contrast, all that is required to remove platen 74 from support block assembly 16 is to unscrew screw 78 from mounting block 64 to remove tear bar 72 from assembly 16, and to remove the two screws securing retainer bracket 68 to mounting block 64. Platen 68 can now be lifted from mounting block 64.

As discussed above with respect to media take-up assembly 12, the entire support block assembly 16 forms an integral unit or module which is secured within a relief 82 (FIG. 1) formed in support housing 34. Support block assembly or module 16 can be easily and quickly removed and/or installed by removing or inserting a pair of screws (not shown) which extend between mounting block 64 and support housing 34. Mounting block 64 also includes an alignment protrusion (not shown) configured to be received within an alignment port formed in support housing 34 to ensure proper positioning of support block assembly or module 16 in relation to support housing 34.

Figure 7:
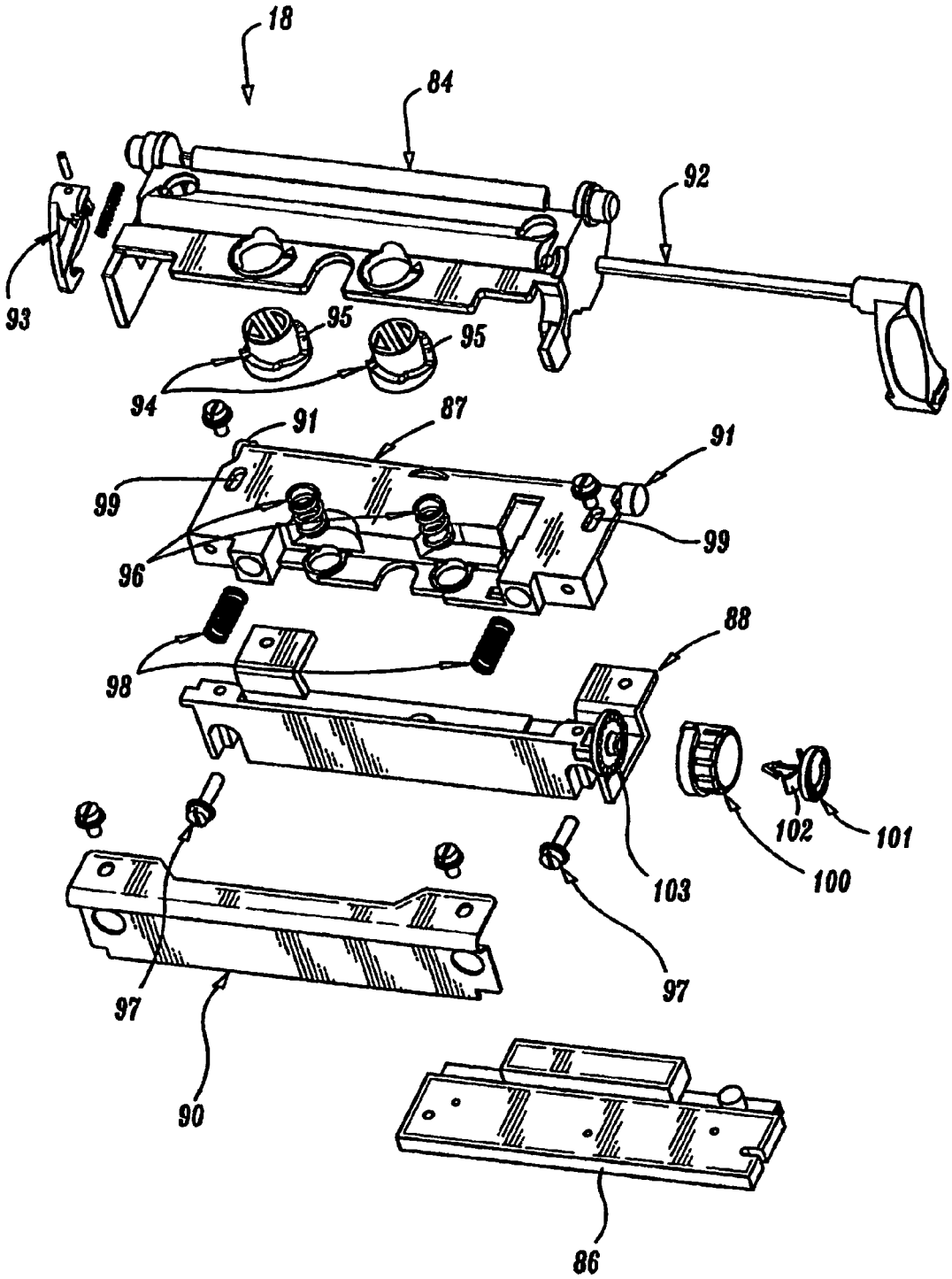
FIG. 7 is a perspective view with parts separated of the printhead assembly of the modular printer shown in FIG. 1.

Referring to FIG. 7, printhead assembly 18 includes a printhead mount 88, a printhead 86, a printhead adjustment bracket 87, and a ribbon shield 90. Printhead 86 includes a pair of pivot members 91, which are pivotably secured to printhead pivot 84. A latch assembly including latch members 92 and 93 is supported on printhead pivot 84 and is movable into a position to retain printhead 86 and printhead assembly 18 in fixed rotatable relation. A rotatable knob 94 having a cam surface 95 formed thereon is supported on each side of printhead 86. The cam surface 95 of each knob 94 is urged into engagement with printhead mount 84 by a spring 96. Both knobs 94 are selectively rotatable to urge printhead 86 away from printhead mount 84 to control printhead pressure of the printhead 86.

Printhead adjustment bracket 88 is secured to printhead adjustment bracket 87 by screws 97 which are positioned within slots 99 formed in printhead adjustment bracket 87. A pair of springs 98 are positioned between bracket 88 and printhead adjustment bracket 87 to urge bracket 88 away from printhead adjustment bracket 87. An adjustment knob 100 having a cam surface positioned to engage printhead 86 is rotatably secured to bracket 88 by a fastener 101 having a biasing member 102 formed therewith. Adjustment knob 100 includes a protrusion (not shown) which is urged into engagement with an annular array of detents 103 by fastener 101. Adjustment knob 100 is rotatable to selectively cam bracket 88 towards printhead 86 against the bias of springs 96. The adjustment knob protrusion and the annular array of detents 103 function to retain the bracket 88 and printhead 86 at fixed positions in relation to each other as determined by the rotational position of adjustment knob 100.

Referring again to FIGS. 1 and 7, the printhead assembly 18 forms an integral unit or module which is bolted to support housing 34 to secure the assembly within the printer.

Figure 8:
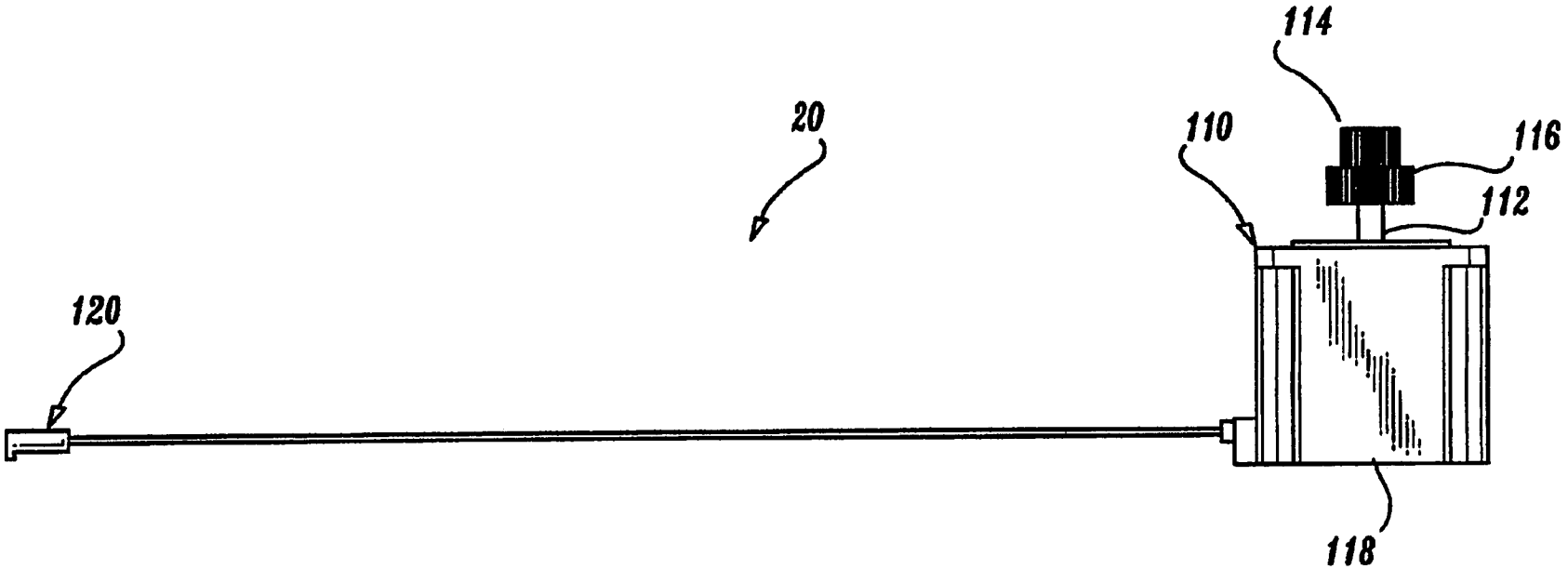
FIG. 8 is a top view of the stepper motor assembly of the modular printer shown in FIG.

Referring to FIG. 8, stepper motor assembly 20 includes a stepper motor 110 having an output shaft 112 and a pair of gears 114 and 116 secured to output shaft 112. Stepper motor 110 is supported within a housing 118. A connector 120 having a contact pin (not shown) extends from housing 118 to facilitate connection of the stepper motor to a power source. Stepper motor assembly 20 forms an integral unit or module.

Referring also to FIG. 2, cast 34 includes first and second mounting locations 122 and 124 configured to receive motor assembly 20. Motor assembly 20 can be secured at either location to selectively position either one of gears 112 or 114 into meshing engagement with one of platen assembly gears 82 or 84 (See FIG. 6). This double gear multi-location mounting arrangement provides for a printer which is capable of changing speed simply by changing the location of the stepper motor on support housing 34. Moreover, since only four screws need be removed, this process can be performed easily and quickly.

Referring again to FIG. 1, printer assembly 10 also includes a media supply hub assembly 130 which includes a hub 132 and an adjustable retaining member 134. Hub 132 includes an elongated slot 138 formed in each side thereof. Adjustable retaining member 134 includes a body 140 having a pair of legs 142. Each leg 142 has a distal end portion (not shown) which is configured to be slidably received in elongated slot 138. When retaining member 134 is advanced to the distal end of slot 138, the slot configuration changes to permit the retaining member 134 to be pivoted from a position perpendicular to hub 132 to a position parallel thereto. In the parallel position, a media supply roll can be positioned on hub 132. After the media supply roll (not shown) is positioned on hub 132, retaining member 134 can be pivoted back to a position perpendicular to hub 132 and slid into contact with the media supply roll to retain the media supply roll on hub 132. The force on retaining member 134 by the media supply roll locks retaining member 134 in position on hub 132. Because retaining member 134 is slidable within slot 138 along the length of hub 132, multiple size media supply rolls can be securely held on hub 132 by retaining member 134. Preferably, hub 132 is constructed from cast aluminum and retaining member 134 is constructed from a reinforced plastic. Alternately, other materials of construction may be used for each of the parts including engineering metal, plastics, ceramics, etc. The media supply assembly 130 can be secured within relief 140 in cast 34 using screws. As described above, relief 140 ensures proper alignment of media supply assembly 130 in relation to the other components of the printer 10.

Figure 9:
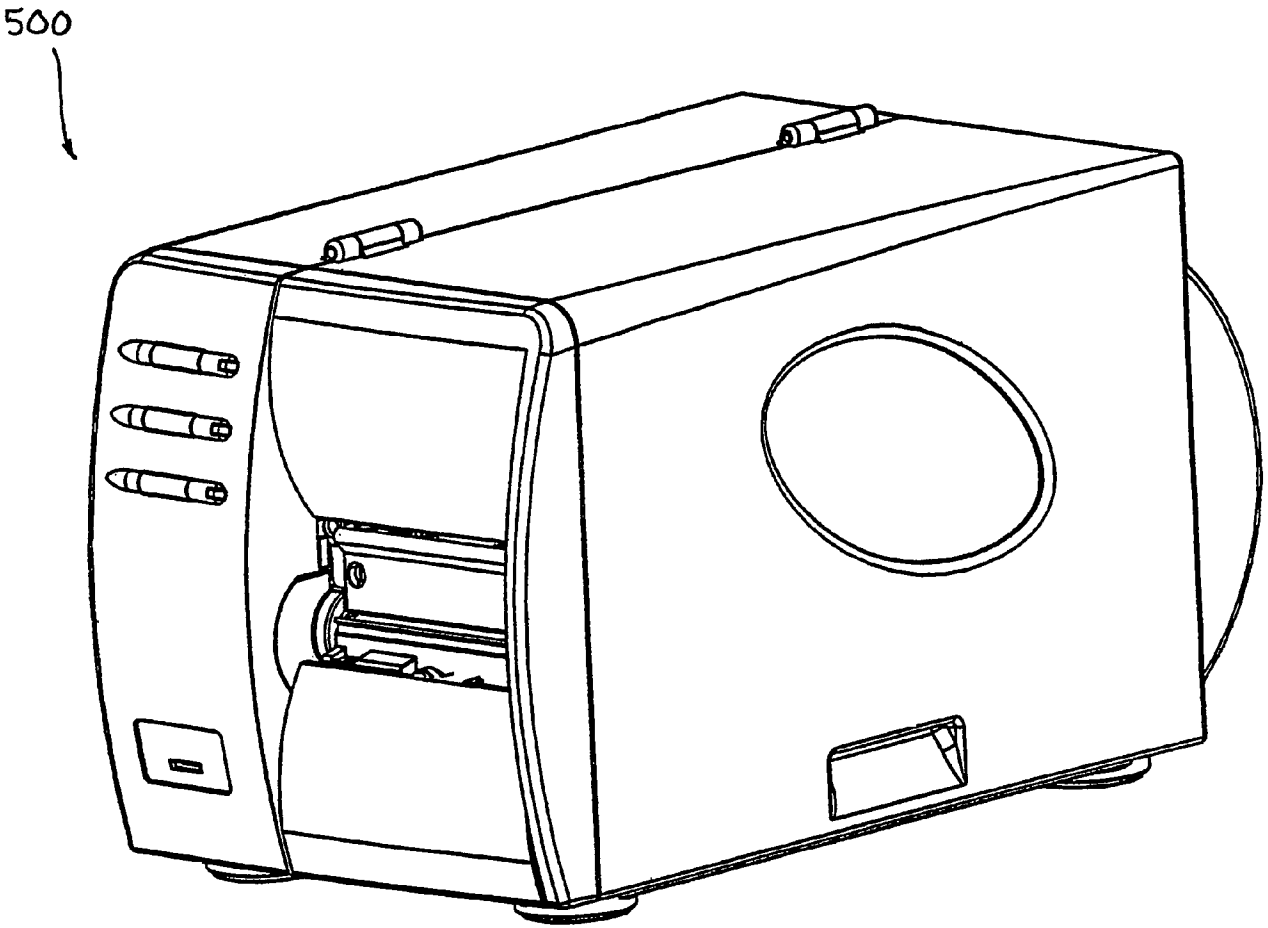
FIG. 9 is a perspective view of another preferred embodiment of the presently disclosed modular printer.
Figure 10:
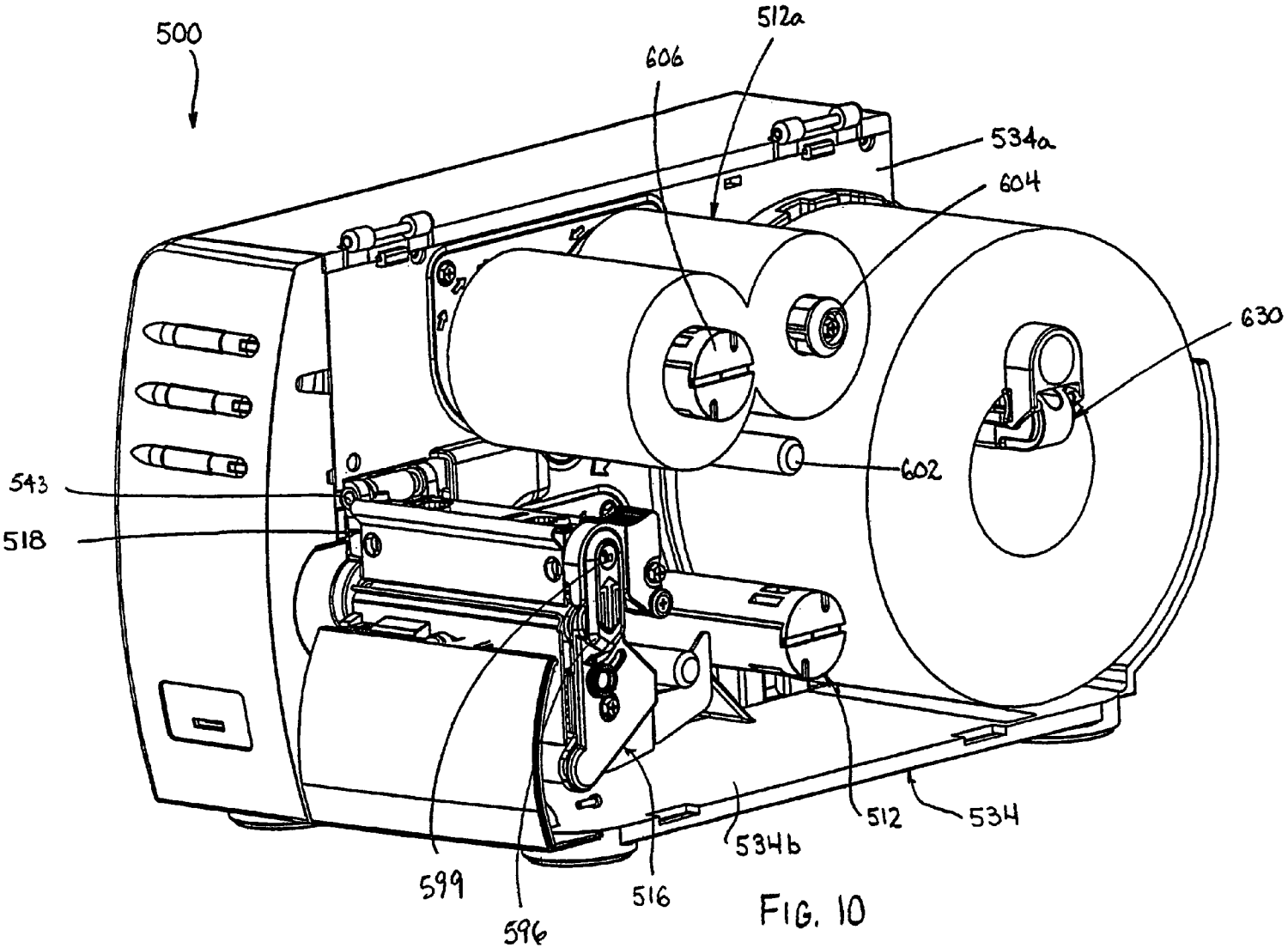
FIG. 10 is a perspective view of the modular printer shown in FIG. 9 with a first half of the outer cover removed.
Figure 11:
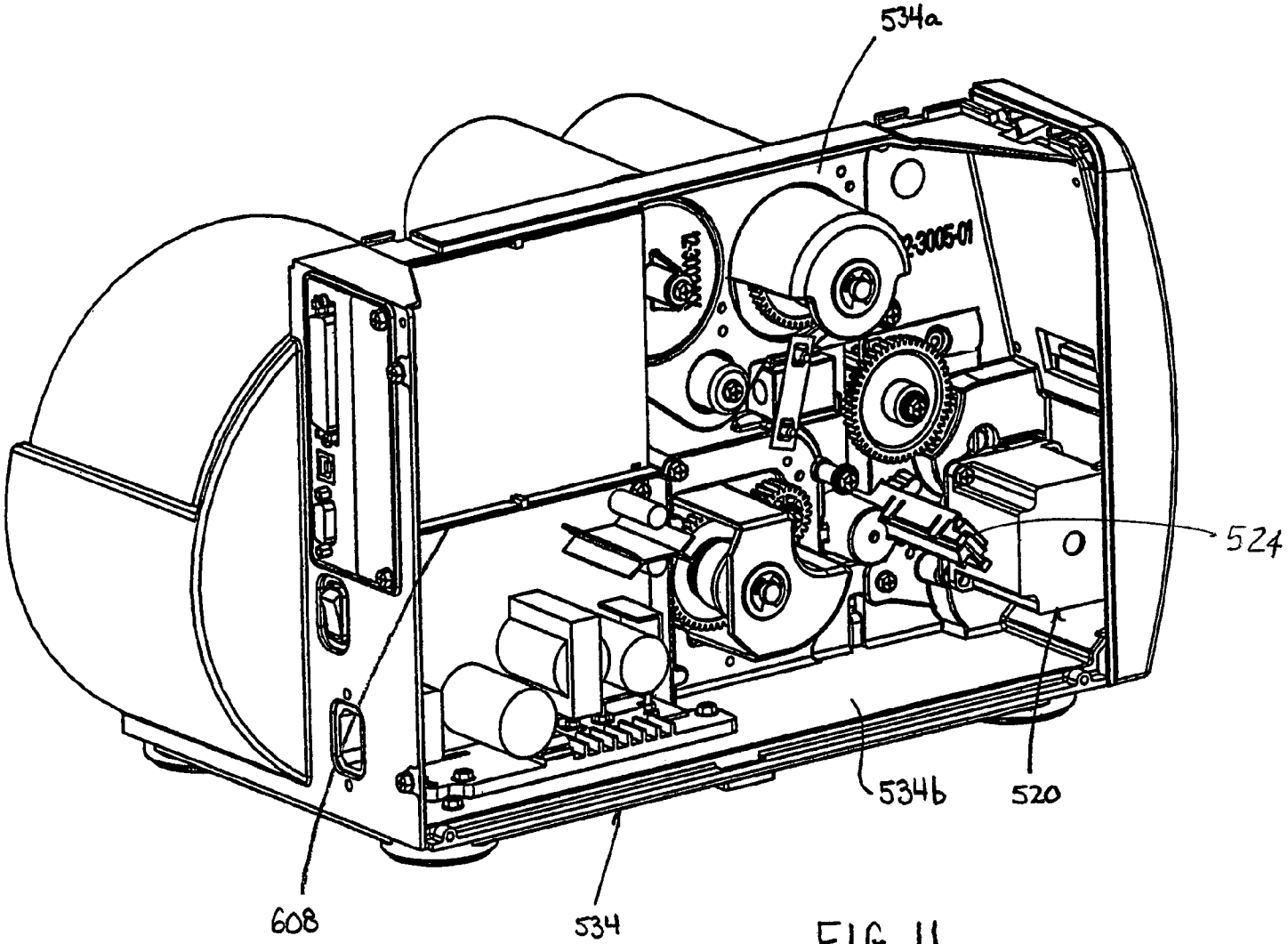
FIG. 11 is a perspective view of the modular printer shown in FIG. 1 with a second half of the cover removed.

FIGS. 9–11 illustrate another preferred embodiment of the presently disclosed modular printer shown generally as 500. Modular printer 500 includes a support body or casting 534. Unlike casting 34 of modular printer 10, casting 534 includes a central support member 534*a* and a base member 534*b* which are monolithically formed from a heat conductive material, such as cast aluminum. By casting the base and the central support member monolithically, heat dissipation from within modular printer 500 is improved. A single casting also simplifies manufacture and assembly of the modular printer. As described above with respect to modular printer 10, modular printer 500 also includes a multiplicity of unit modules which are independently attachable to and detachable from casting 534. The modules include a printhead assembly module 518, a support block assembly module 516, a thermal ink printer media take-up assembly module 512, an ink ribbon printer media take-up assembly module 512*a*, a media supply hub 630, and a stepper motor 520 (FIG. 11). Casting 534 includes recesses configured to receive each of the modules in a specific orientation such that when each of the modules is secured to casting 534, the modules are supported in an operative configuration. As such, the modular printer can be easily converted from an ink ribbon printer to a thermal ink printer by installing the appropriate print head assembly module and the appropriate media take-up assembly module into the modular printer.

Figure 10A:
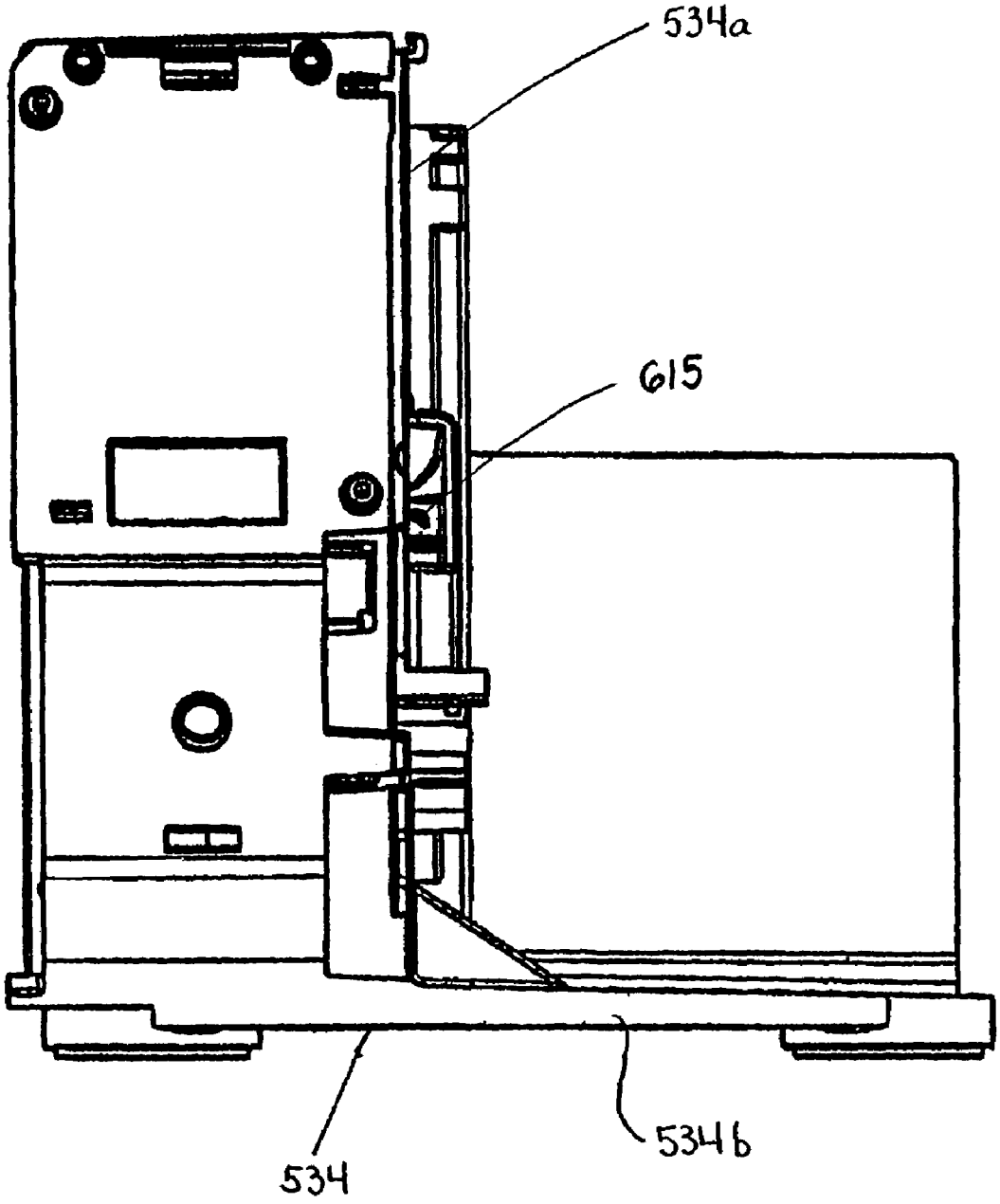
FIG. 10A is a side view of the modular printer shown in FIG. 9 with a first half of the cover and the printer modules removed.
Figure 10B:
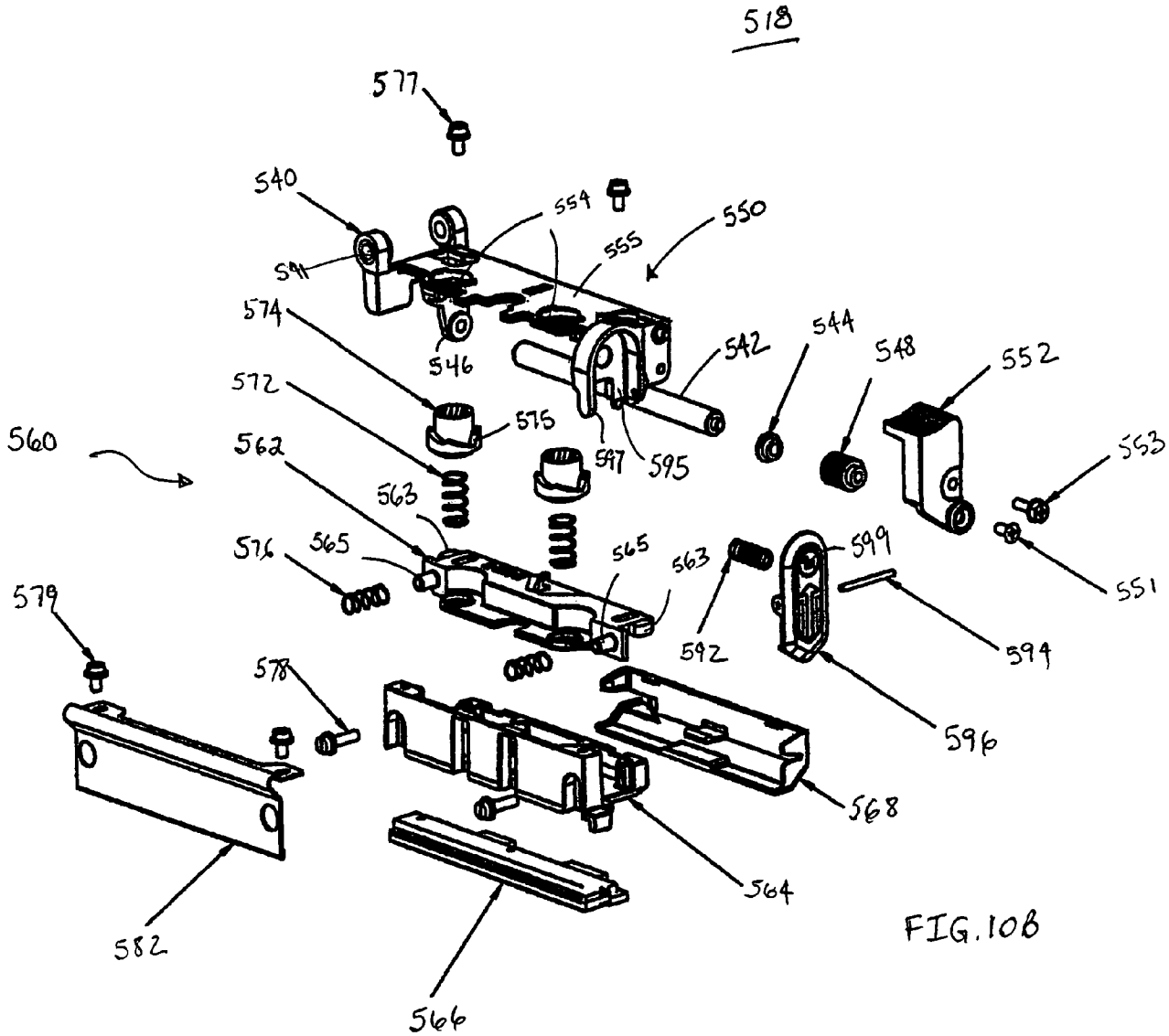
FIG. 10B is an exploded perspective view of a printhead assembly according to an embodiment of the present disclosure.

In a preferred embodiment, printhead assembly module 518 includes a platen assembly 550. In this exemplary configuration, as shown in FIG. 10B, platen assembly 550 includes a mounting block 540, a platen roller 542, first and second bearings 544, 546, a drive gear 548, and a support arm 552. First bearing 544 is attached to a first end of platen 542 and is preferably press fitted to platen roller 542. Second bearing 546 is attached to mounting block 540 such that it is substantially perpendicular to a longitudinal axis of mounting block 540. Configured thusly, second bearing 546 is configured and adapted to engage a second end of platen roller 542. Preferably, both ends of platen roller 542 are tapered, or chamfered to facilitate attachment of first and second bearings 544, 546. Drive gear 548 is attached, preferably by press fitting, to first bearing 544. As drive gear 548 rotates, it transfers rotational forces to platen roller 542, thereby causing rotational motion of platen 542. A pair of holes 541 is disposed on one end of mounting block 540 and the holes 541 are configured and adapted to pivotably engage a rod 543 (see FIG. 10).

Support arm 552 is disposed outboard of drive gear 548 and maintains the relative positions of platen roller 542 and mounting block 540. Support arm 552 is attached to mounting block 540 by a screw 553. Additionally, support arm 552 includes a screw 551 that engages a threaded recess in drive gear 548. As assembled, platen roller 542 rotates relative to mounting block 540 with first and second bearings 544, 546 reducing frictional losses during rotation of platen roller 542. Mounting block 540 includes a pair of spaced apart orifices 554 that is disposed on an upper surface 555 of mounting block 540.

Printhead assembly module 518 further includes a printhead assembly 560 that mates with platen assembly 550. Still referring to FIG. 10B, printhead assembly 560 includes an upper adjustment bracket 562 and a lower adjustment bracket 564 that are configured and adapted to engage one another. Attached to the lower adjustment bracket 564 is printhead 566. A cover 568 is provided that positively engages with the assembled upper and lower adjustment brackets 562, 564 to minimize foreign matter from entering the printhead assembly 560 and to maintain the relative positions of the printhead 566, lower adjustment bracket 564, and the upper adjustment bracket 562. Upper adjustment bracket is attached to lower adjustment bracket 564 using a pair of screws 578. Springs 576 are disposed between screws 578 and upper adjustment bracket 562.

More particularly, a pair of receptacles 565 is located on a surface of upper adjustment bracket 562 that are adapted to screwingly engage screws 578 and slidingly receive springs 576 along an outer surface thereof.

A pair of knobs 574 is vertically positioned on upper adjustment bracket 562 and is biased by springs 572. Each knob 574 is configured and adapted to fit within the orifices 554 of the mounting block 540. Each rotatable knob 574 has a cam surface 575 formed thereon. The cam surface 575 of each knob 574 is urged into engagement with mounting block 540 by spring 572 such that each knob 574 extends vertically beyond upper surface 555 of mounting block 540. Upper adjustment bracket 562 includes a pair of pivot members 563, which are pivotably attached to platen assembly 550 thereby allowing printhead 566 to be selectively pivoted into a desired position relative to platen assembly 550. Both knobs 574 are selectively rotatable to urge printhead 566 towards or away from platen assembly 550 to control printhead pressure of the printhead 566. A ribbon shield 582 is provided and is attached to the upper adjustment bracket 562 using a pair of screws 579.

A printhead latch 596 is positioned on one side of mounting block 550 and is pivotably movable into and out of recess 595. A pivot member 594 extends through printhead latch 596 and engages holes 597 that are disposed in recess 595. Printhead latch 596 is biased by spring 592 that is disposed between printhead latch 596 and recess 595.

As shown in FIG. 10, a portion of printhead latch 596 releasably engages a portion of support block assembly module 516. Printhead assembly module 518 is pivotably mounted in printer 500. By applying pressure on button 599 of printhead latch 596, the normal bias of spring 592 is overcome thereby pivoting printhead latch 596 about pivot member 594 and releasing printhead latch 596 from support block assembly 516. After printhead latch 596 is released from support block assembly 516, printhead assembly module 518 is pivotable about rod 543. When the printhead assembly module 518 is pivoted away from its normal or ready position as seen in FIG. 10, replacement of the ribbon or other maintenance may be performed. Since the printhead assembly 560 and the platen assembly 550 pivot together when the printhead assembly module is pivoted, alignment between the printhead assembly 560 and platen assembly 550 is maintained.

Modular printer 500 differs from modular printer 10 described above in several respects. More specifically, modular printer 500 includes an additional idler roller 602 positioned between media supply hub 630 and printhead assembly module 518. Idler roller 602 prevents the media ribbon from becoming wrinkled during operation of the printer. Ribbon take-up assembly module 512*a* includes a ribbon supply assembly 604 and a ribbon take-up assembly 606, each of which is detachable from and attachable to casting 534 using three screws. This allows for easy installation and removal of the media take-up assembly module. Alternately, a fewer or greater number of screws may be used to secure each roller to the casting. The electrical components of modular printer 500 are secured to central support member 534*a* on a side opposite to the printing components of printer 500. The electrical components include electronic circuitry and the drive mechanism for powering the various system modules as discussed above with respect to modular printer 10. The electronic circuitry includes circuit boards which are removably installed into a mounting bracket 608 (FIG. 11) supported on central support member 534*a*. Different circuit boards can be installed for selectively controlling operation of the printer. For example, different circuit boards or additional circuit boards may be installed to convert the printer from a thermal ink printer to an ink ribbon printer.

Figure 19:
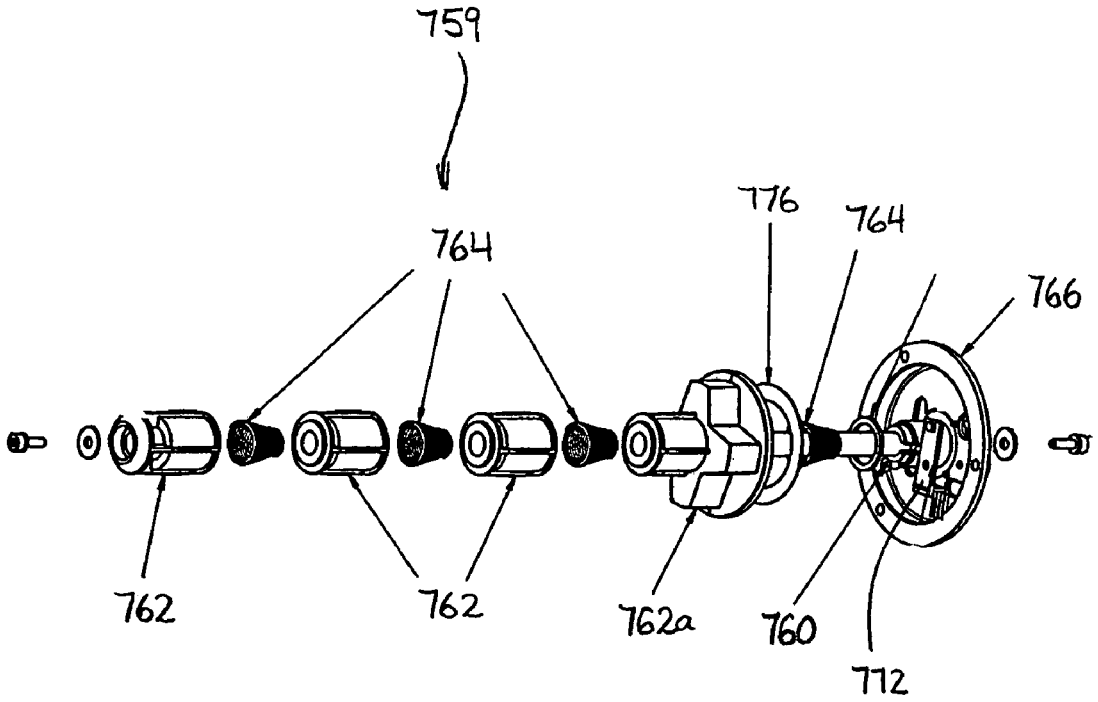
FIG. 19 is a side perspective view with parts separated of the hub assembly of the ribbon supply assembly.

Modular printer 500 also includes a pickup sensor, which communicates with the electrical circuitry of the printer and is supported on the mounting bracket or adjacent thereto to monitor operation of the ribbon supply assembly 604. By monitoring operation of the ribbon supply hub, the pickup sensor is able to track the quantity of ribbon remaining on the ribbon supply assembly 604. Details and operation of the ribbon pickup sensor are described hereinafter with reference to printer 700 and as shown in FIG. 19.

Additionally, modular printer 500 includes a media sensor assembly 524, which communicates with associated circuitry in printer 500 and is supported on portion 534*a* of casting 534, as shown in FIG. 11. Media sensor assembly 524 monitors the presence or absence of printing media, such as label stock. Further still, media sensor assembly 524 is configurable and adaptable for monitoring the printing media for indicia indicating physical boundaries, or edges of the printing media. For example, media sensor assembly 524 may monitor the printing media for a predetermined mark on the underside of the printing media. A signal is generated by the media sensor assembly 524 indicating the presence or absence of the indicator. This signal is communicated to the associated circuitry in printer 500 where the associated circuitry determines where the physical edge of the printing media is located using information included in the signal.

An example of a media sensor assembly is disclosed in U.S. Pat. No. 6,396,070 to Christensen et al., the contents of which are hereby incorporated by reference in their entirety. Another example of a media sensor assembly is disclosed in United States Patent Application Serial No. 10/668,127, filed Sep. 22, 2003, the contents of which are hereby incorporated by reference in their entirety.

More particularly, media sensor 524 includes a sensor assembly installed above the print media. Optionally, a second sensor assembly may be placed below the print media. A sensor base is included and has rounded edges to aid in passing the print media therebetween. The sensor assembly may be used with a reflected light sensor, in which case, the sensor is both a source and a detector of light, requiring only one sensor assembly. In this case, the print media passes the sensor assembly and reflects light back to sensor assembly, which is read and processed.

Optionally, media sensor 524 includes a second sensor assembly, where the first sensor assembly transmits a light impulse from sensor source through the print media to second sensor assembly where the signal is received by a detector. Sensors can be used to determine if print media is present, to read a position indicating stripe, to determine the location of the print media edge or to measure the presence of gaps for labels. Sensor slides inside each sensor assembly are positionable to corresponding positions for accommodating differing sizes of the print media.

Modular printer 500 also includes an engagement member 615 (FIG. 10A) which extends from central portion 534*a* of casting 534 and is positioned adjacent to the pivot point of the printhead assembly module to engage printhead adjustment bracket of the printhead assembly module as adjustment bracket is pivoted towards printhead mount. The printhead adjustment bracket includes a pair of pivot members which are slidably positioned in vertical slots in the printhead pivot. As the adjustment bracket is pivoted towards printhead mount and the media positioned within the printhead assembly module 518, the printhead adjustment bracket engages member 615. Engagement between the printhead adjustment bracket and member 615 cams the pivot members upwardly in the vertical slots to lift the backend of the adjustment bracket to allow for substantially parallel closure of the bracket 587 onto the printhead mount. This parallel closure prevents crimping or gouging of the media supply.

Figure 12:
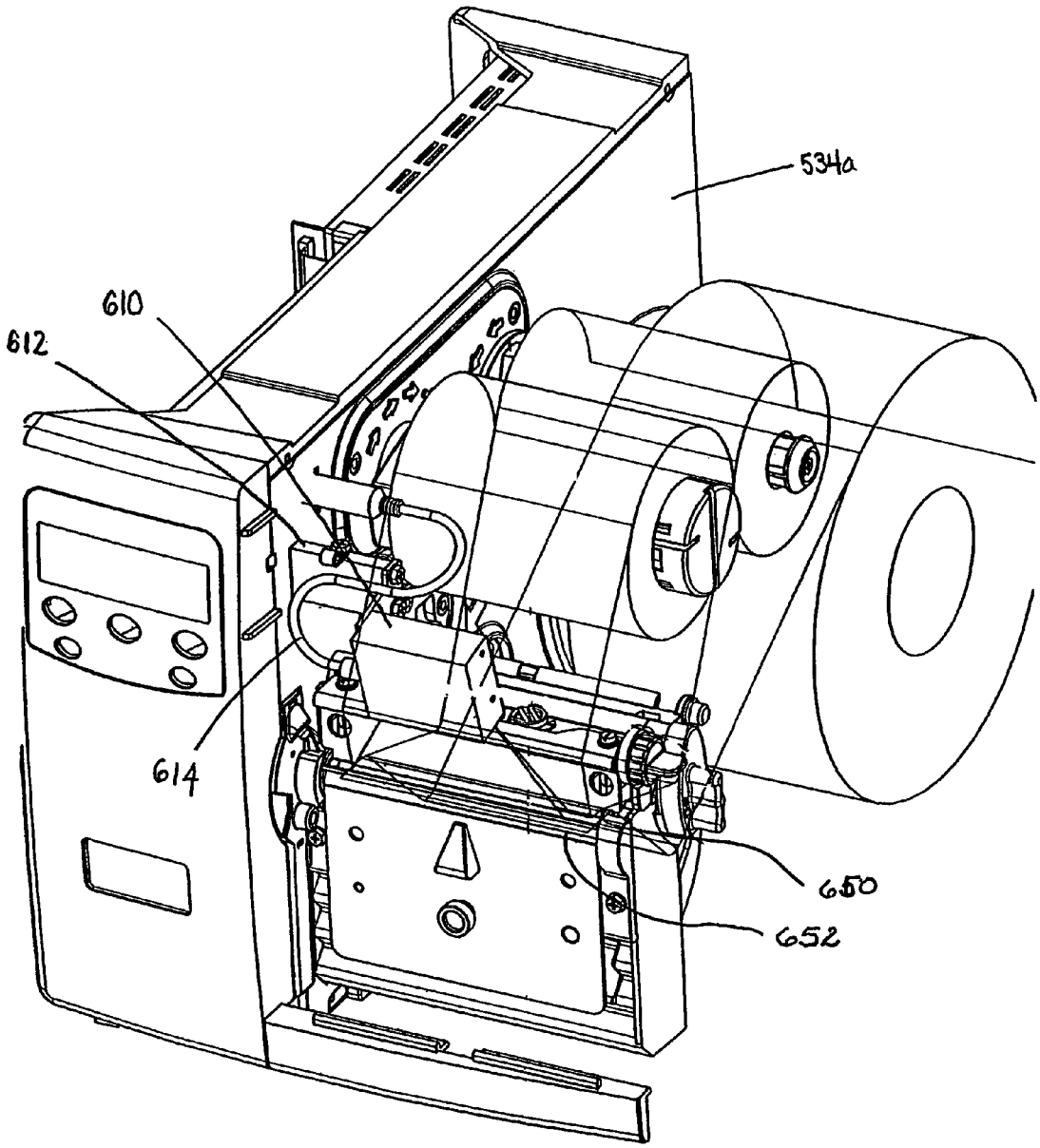
FIG. 12 is another preferred embodiment of the presently disclosed modular printer including a scanner.

As shown in FIGS. 10 and 12, a number of modular accessories can be attached/connected adjacent the front portion of the printer. These accessories in substantially self contained units include, but are not limited to, sensors (not shown), cutters 650, peel mechanisms 652, etc. These accessories include an integral connector(s) for power and data signals.

Referring to FIG. 12, in a preferred embodiment, modular printer 500 includes a scanner 610 which is mounted on central support member 534*a* by a bracket assembly 612 which is fastened to casting 534 by two screws. Scanner 610 is electrically connected to the electrical circuitry of the modular printer 500 by a conductive cable 614. Scanner 610 can be easily removed from modular printer by disengaging the scanner from the bracket assembly or disengaging the bracket assembly from casting 534.

FIGS. 13–24 illustrate another preferred embodiment of the presently disclosed printer or print engine shown generally as 700. Printer 700 includes many of the modular features discussed above with respect to printers 10 and 500. Printer 700 offers both direct thermal printing and thermal transfer printing capabilities. Direct thermal printing uses specially treated label stock which contains dyes that turn black upon application of heat and pressure. Thermal transfer printing requires the use of a ribbon substrate having ink which is transferred onto a media upon application of heat and/or pressure to the ribbon substrate.

Figure 13:
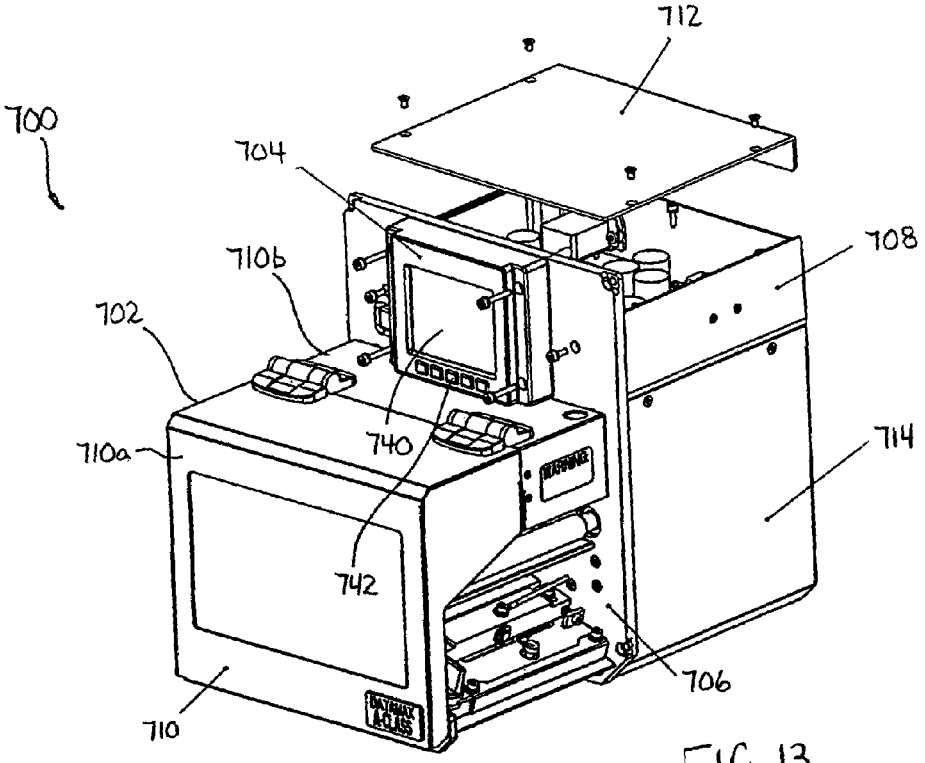
FIG. 13 is a perspective view of yet another preferred embodiment of the presently disclosed modular printer.

Referring to FIG. 13, printer 700 includes a cover assembly 702, a display assembly 704, a centerplate 706 and a power supply assembly or module 708. Cover assembly 702 includes a front cover 710 having an outer cover 710*a* and an inner cover 710*b*, a top cover 712 and a rear cover 714. Outer cover 710*a* is hingedly secured to inner cover 710*b* to facilitate easy access to the internal components of printer 700. Centerplate 706 defines an internal support wall of printer 700 and is preferably formed of a material having good heat transfer characteristics, e.g., aluminum. The electronics and drive mechanisms are supported on one side of the centerplate 706 and the printer components are supported on an opposite side or media side of centerplate 706 as will be discussed in further detail below.

Figure 14:
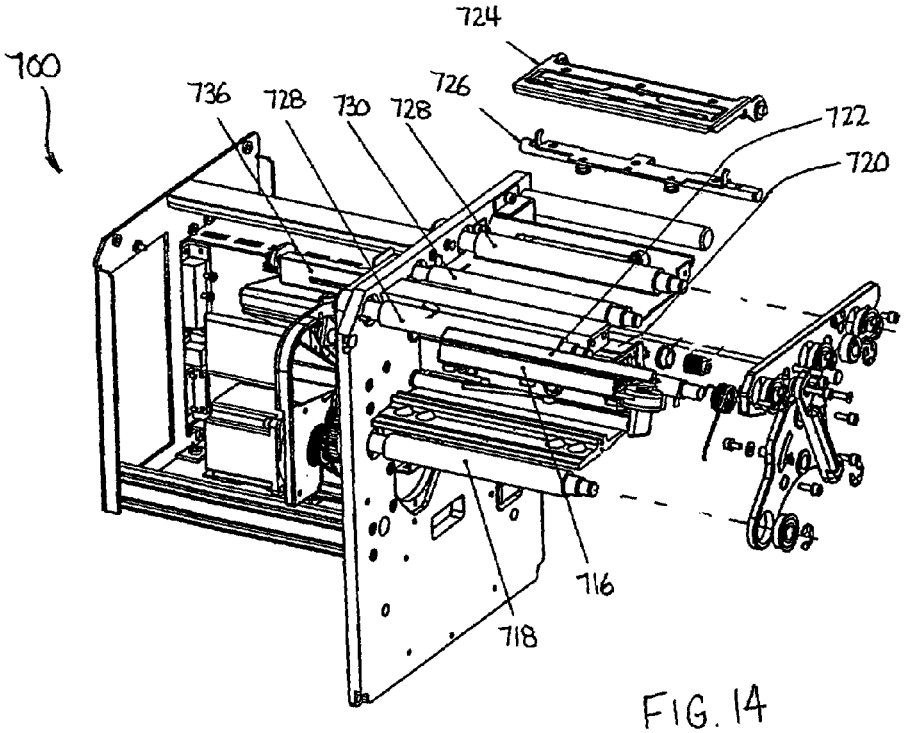
FIG. 14 is a bottom, side perspective view of the modular printer shown in FIG. 13 with the entire cover removed and the ribbon supply module and ribbon take-up module removed.
Figure 14A:
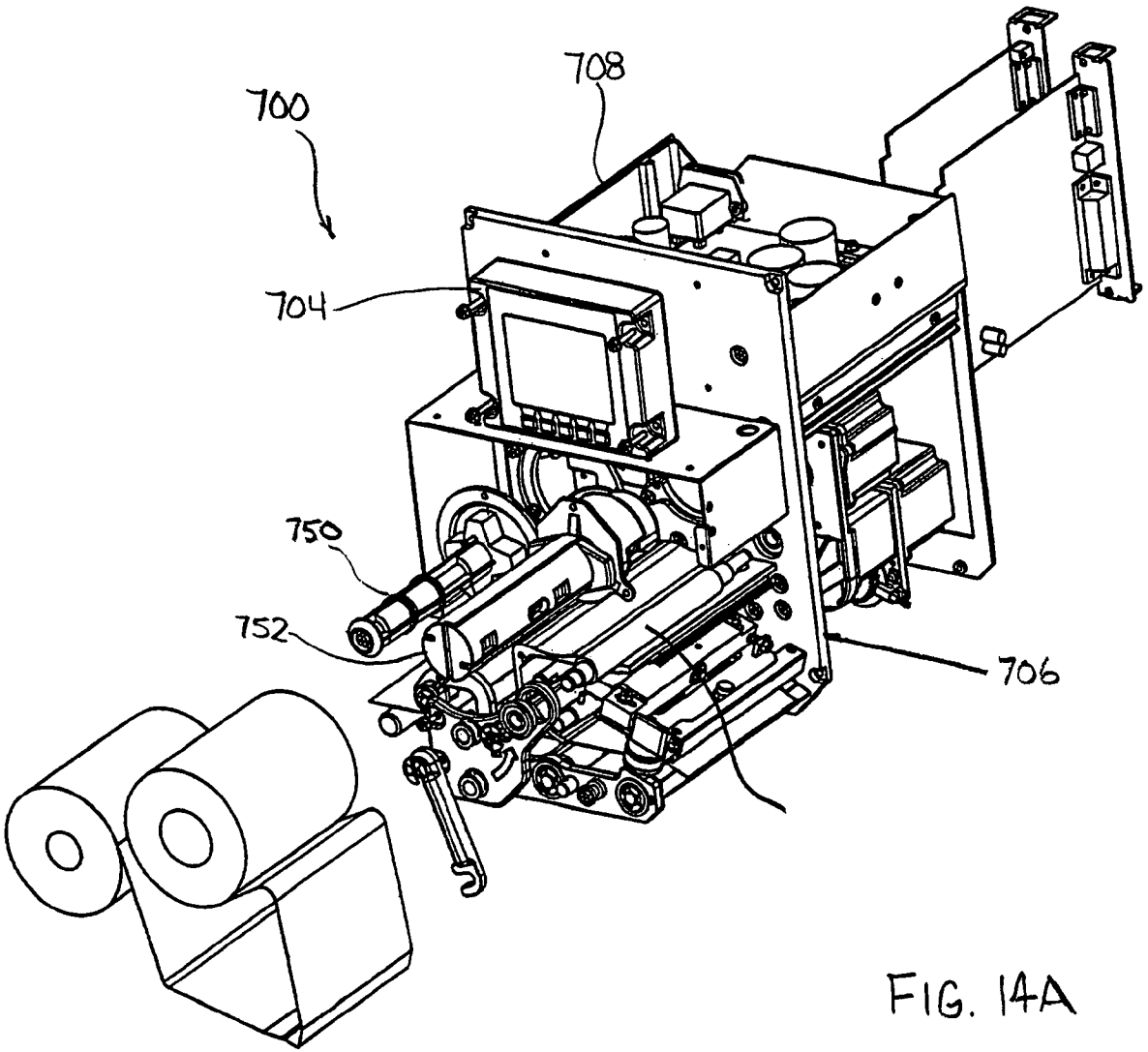
FIG. 14A is a top, front perspective view of the modular printer shown in FIG. 13 with a portion of the cover removed and a roll of ribbon and a pair of circuit boards separated therefrom.
Figure 15:
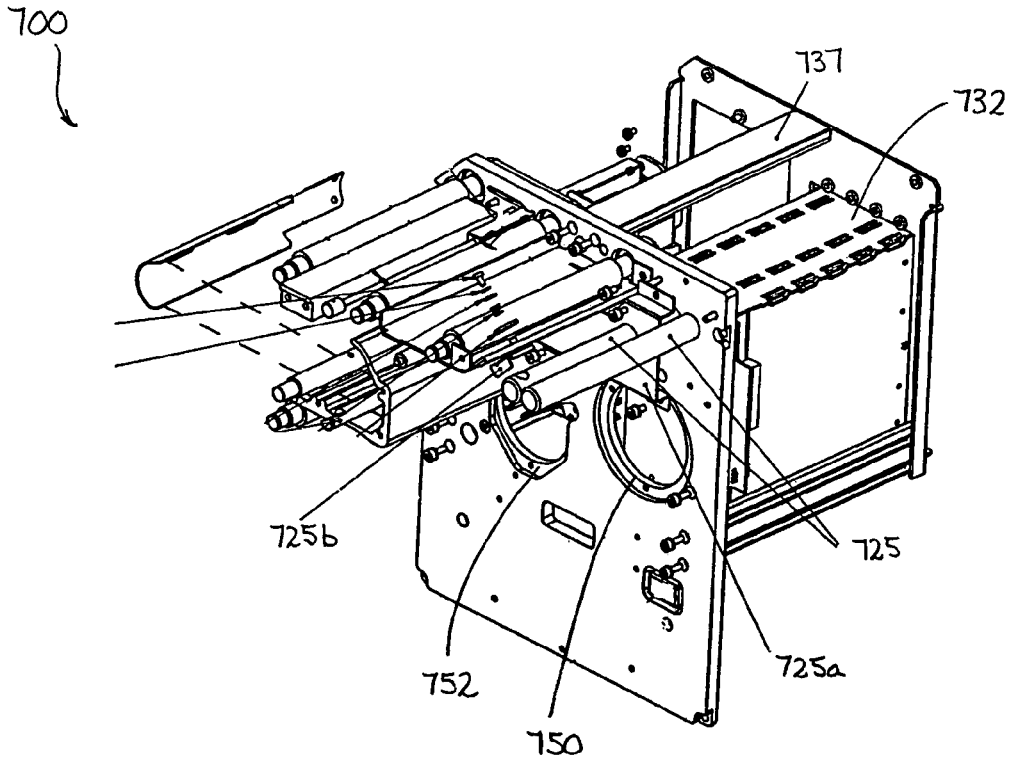
FIG. 15 is a bottom, opposite side perspective view of the modular printer shown in FIG. 14.
Figure 16:
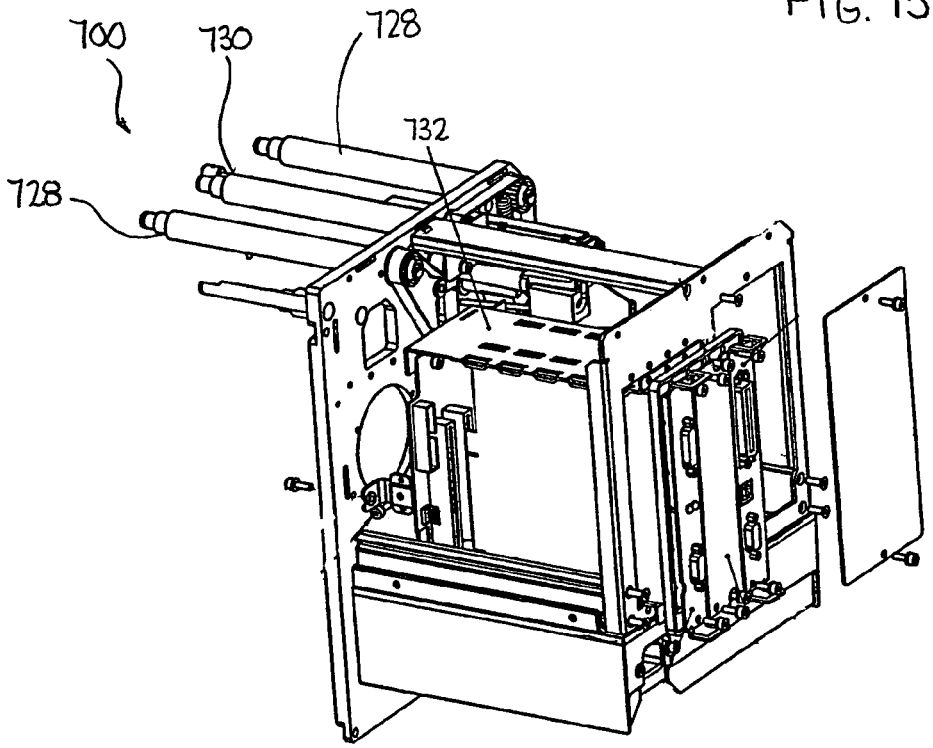
FIG. 16 is a rear perspective view of the modular printer shown in FIG. 15 with the power supply module attached to the centerplate.
Figure 17:
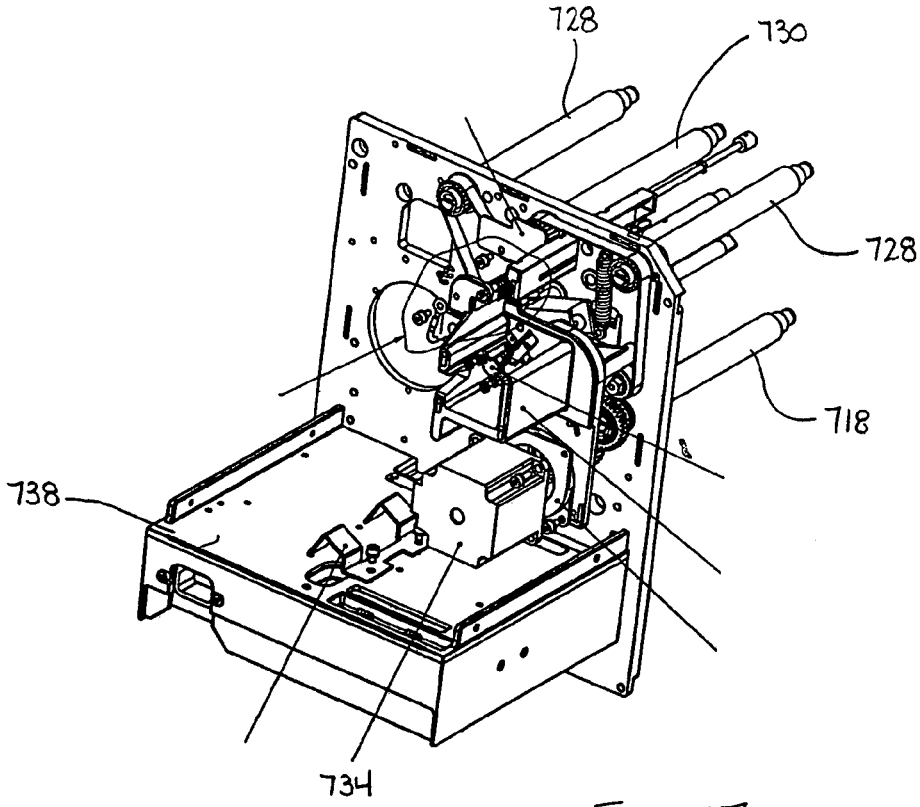
FIG. 17 is a rear bottom perspective view of the modular printer shown in FIG. 16 with the card cage assembly removed.

Referring to FIGS. 14–17, the media side of printer 700 includes a printhead assembly 716, a take-up roller assembly 718, a ribbon idler shaft 720, a peel bar 722, a pinch roller assembly 724, media posts 725, a media guide plate 725*a*, an adjustable media guide 725*b*, a latch assembly 726, a main platen roller assembly 728, and a peel plate roller assembly 730. The electronics side of printer 700 includes power supply assembly 708, a card cage assembly 732, stepper motor assembly 734 and a media sensor assembly 736 (FIG. 14). A rear support block 737 provides additional structural support to printer 700. Power supply assembly 708 is modular in construction and is supported on a support plate 738 (FIG. 17). The modular construction of power supply assembly 708 facilitates easy assembly and maintenance of printer 700. Card cage assembly 732 is configured to slidably receive the main logic card of printer 700 and applicator cards (not shown), as well as optimal electronic interface cards. Card cage assembly 732 includes printed wiring assemblies. Cage assembly 732 allows for field upgrades of printer 700 and easy servicing and maintenance.

Referring again to FIG. 14, a display assembly 704 is supported on the media side of centerplate 706. Display assembly 704 preferably includes an electronic liquid crystal graphics display 740. Preferably, display assembly 704 is rotatably mounted on printer 700 to allow for easy reading of display 740 when printer 700 is mounted upside down. The display assembly 704 identifies the status of printer 700 and includes operational and menu keys 742 which allow an operator to change parameters of printer 700 that control operation of the printer. Preferably, the display 740 is capable of displaying commands and the parameters of operation in multiple languages.

In use of printer 700, a label stock is drawn by main platen roller 728 from a supply roll located externally of printer 700 through a media sensor of media sensor assembly 736 under a thermal printhead of printhead assembly 716. The media sensor (not shown) senses the presence of label stock by sensing a top edge of a label or indicia on a bottom surface of a label which coincides with a top edge of the label. Once the edge of the label is detected, printer 700 is capable of shifting the print location to print on any desired portion of the label. When the label is passed under the thermal printhead, the printhead heats the thermally sensitive label or ribbon positioned adjacent the label to form small black dots on the label. The small dots are grouped to form characters, bar codes or graphic images. By having graphics printing capabilities, printer 700 is able to print an unlimited number of characters and, thus, can print in a variety of different languages including Chinese, Korean, Russian and Arabic. Printer 700 is also capable of printing an unlimited number of graphics including corporate logos, graphs and/or charts and an infinite variety of different symbols.

After an image is processed on the label, the label stock including a liner and label is moved past the thermal printhead and wrapped over peel bar 722 (FIG. 14) and against an overdriven roller of peel plate roller assembly 730. The overdriven roller forces a tight bend in the label stock and creates high shear stresses to form between the label and the liner. As a result of the high stresses, the label separates from the liner and is fed out of the front of the printer. The liner is fed to the rear of the media side of printer 700.

As discussed above, printer 700 is configured to accommodate easy to install modular assemblies similar to those disclosed above with respect to printer 10.

Figure 18:
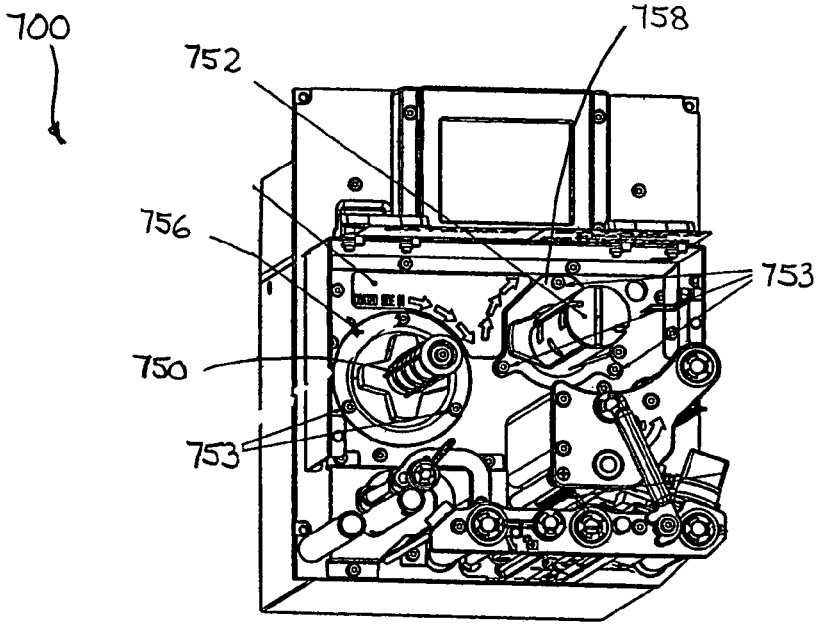
FIG. 18 is a front perspective view of the modular printer shown in FIG. 13 with the front cover removed.

Referring to FIG. 18, when printer 700 functions as a thermal transfer printing apparatus, a ribbon supply assembly or module 750 and a ribbon take-up assembly or module 752 are installed into printer 700. Preferably, recesses 756 and 758 are provided in centerplate 706 to receive and accurately position the ribbon supply and take-up modules within the media side of printer 700. One or more screws 753 may be used to secure the modules to centerplate 306.

Figure 20:
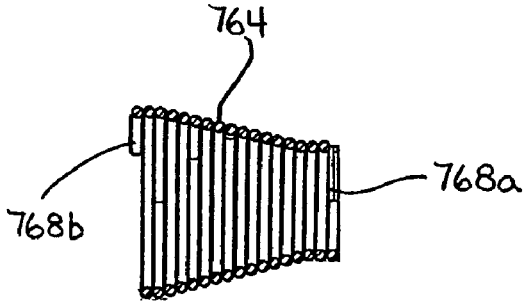
FIG. 20 is a side cross-sectional view of a torsion spring of the hub assembly shown in FIG. 19.

Referring to FIGS. 19 and 20 in a preferred embodiment, ribbon supply assembly 750 includes a hub assembly 759 including, a ribbon supply shaft 760, a plurality of hub portions 762, independently rotatably positioned about shaft 760, a plurality of torsion springs 764 positioned between adjacent hub portions 762, and a ribbon support housing 766. Each torsion spring 764 includes a bend 768*a* and 768*b* formed at each end thereof. Bend 768*a* is positioned to non-rotatably engage ribbon supply shaft 760 and bend 768*b* is positioned to non-rotatably engage a respective hub portion 762.

In use, a spool of ribbon is positioned about hub assembly 759 and is in contact with hub portions 762. Ribbon take-up assembly includes a hub (not shown) which is driven by the drive mechanism of printer 700 to unwind ribbon from the spool of ribbon positioned on hub assembly 759 of ribbon supply assembly 750. As ribbon is unwound from hub assembly 759, torque from the spool of ribbon is translated from the spool of ribbon, through hub portions 762 and torsion springs 764 to ribbon supply shaft 760. As a result, a back tension is created in the ribbon as each torsion spring is put in torque. Because the hub portions are independently rotatable about shaft 760, the amount of back tension is created in the ribbon is proportional to the width of the spool of ribbon. More specifically, if a spool of ribbon has a width equal to the length of two hub portions 762, only the torsion springs associated with the two hub portions in contact with the spool of ribbon will provide back-tension in the ribbon. As the width of the ribbon increases, additional hub portions 762 are engaged by the spool of ribbon and, thus, the additional torsion springs contribute to the back tension in the ribbon.

Referring again to FIG. 19, preferably, a sensor is provided in the ribbon supply assembly to indicate whether the ribbon supply assembly 750 is rotating and how much ribbon is remaining in ribbon supply assembly 750. In a preferred embodiment, an electronic sensor 772, e.g., laser or infra red sensor, is positioned in a ribbon support housing 766 of the ribbon supply assembly and a sensor label 776 is secured on an inner hub portion 762*a* of hub assembly 759. Electronic sensor 772 is connected to the electronic circuitry of printer 700 and is positioned to recognize when hub assembly 759 is rotating and ribbon is being unwound. In a preferred embodiment, indicia is provided on the sensor label 776 which is read by the sensor 772 as sensor label 776 rotates with hub assembly 759. For example, lamp black and silver stripes may be provided on sensor label 776. As the spool of ribbon unwinds at a particular rate, the speed of rotation of hub shaft 759 increases as the diameter of the ribbon spool decreases. Sensor 776 registers the speed of the hub assembly to provide an indication of how much ribbon is remaining on the spool. Alternately, different colors and/or indicia and/or sensor mechanisms may be provided.

In a preferred embodiment, printer 700 includes a ribbon saver mechanism that permits the feeding of label stock independently of the supply of ribbon to allow for printing on only a small portion of the label. The ribbon saver mechanism includes a motor assembly 780 (FIG. 21) and a cam assembly 782 (FIG. 22) which function to lift the printhead of printhead assembly at a prescribed moment, i.e., when the desired printing operation is complete, and a brake assembly 784 for stopping rotation of the ribbon supply assembly 750.

Figure 21:
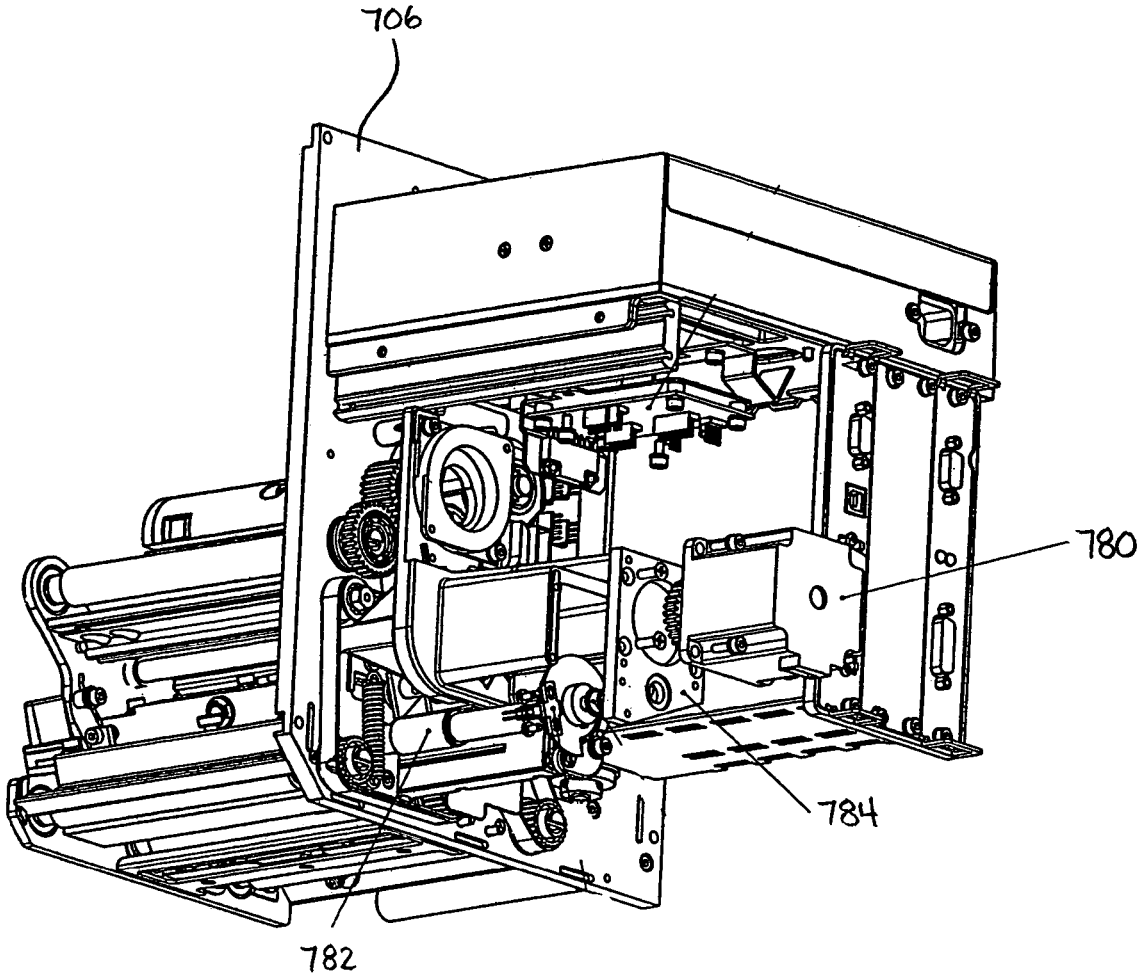
FIG. 21 is a side perspective view of the modular printer shown in FIG. 16 with the motor and cam assembly of the ribbon saver mechanism secured thereto.
Figure 22:
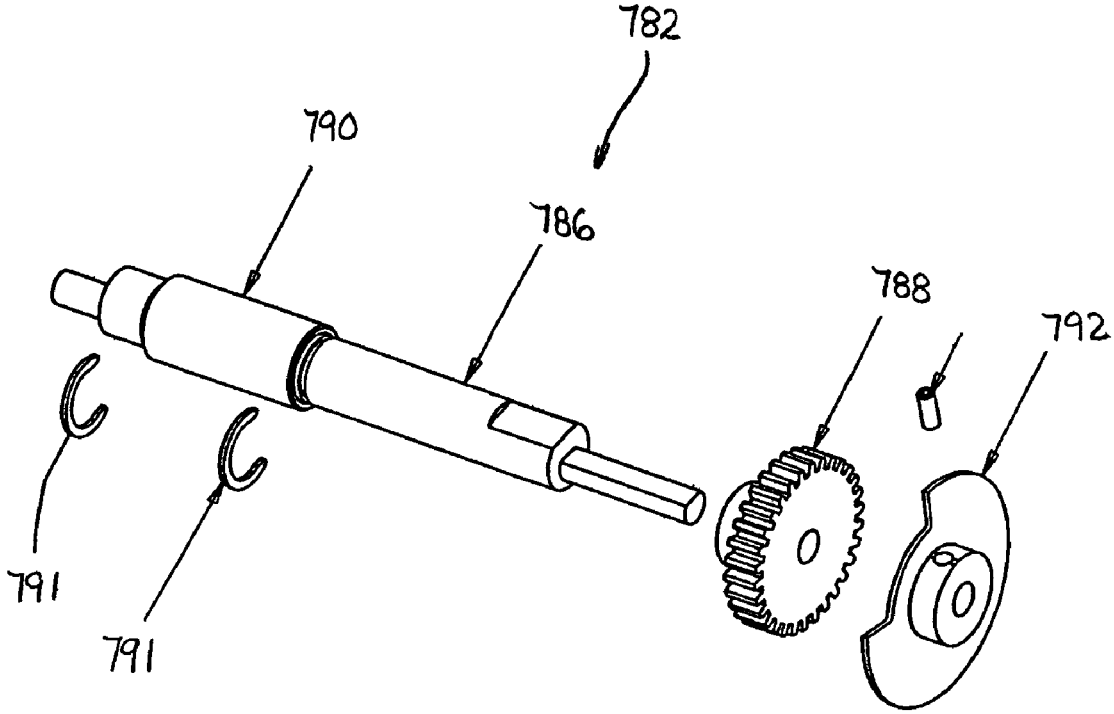
FIG. 22 is a side perspective view of the cam assembly of the ribbon saver mechanism of the modular printer shown in FIG. 21.

Referring to FIGS. 21 and 22 motor assembly 780 of the ribbon saver mechanism is mounted on the electronics side of centerplate 706 as a module which is secured to a motor mounting plate 784. Cam assembly 782 includes a shaft 786 which is rotatably supported between centerplate 706 and motor mounting plate 784. Shaft 786 has a gear 788 mounted on one end thereof and an eccentric bushing 790 positioned on an opposite end thereof. Bushing 790 is axially fixed on shaft 786 between two C-clips 791. See FIG. 22. The eccentric bushing 790 is positioned beneath one end of printhead assembly 716. Motor assembly 780 is operably engaged with gear 788 of cam assembly 782 such that when motor assembly 780 is actuated, shaft 786 is rotated to rotate eccentric bushing 790 beneath printhead assembly 716. Rotation of bushing 790 effects movement of the printhead of printhead assembly 716 between raised and lowered positions. A timing disk 792 (FIG. 22) is secured to shaft 786 adjacent gear 788. Timing disk 792 rotates with shaft 786 and includes a cutout 792*a* which operates a limit switch (not shown) to control operation of motor assembly 780.

Figure 23:
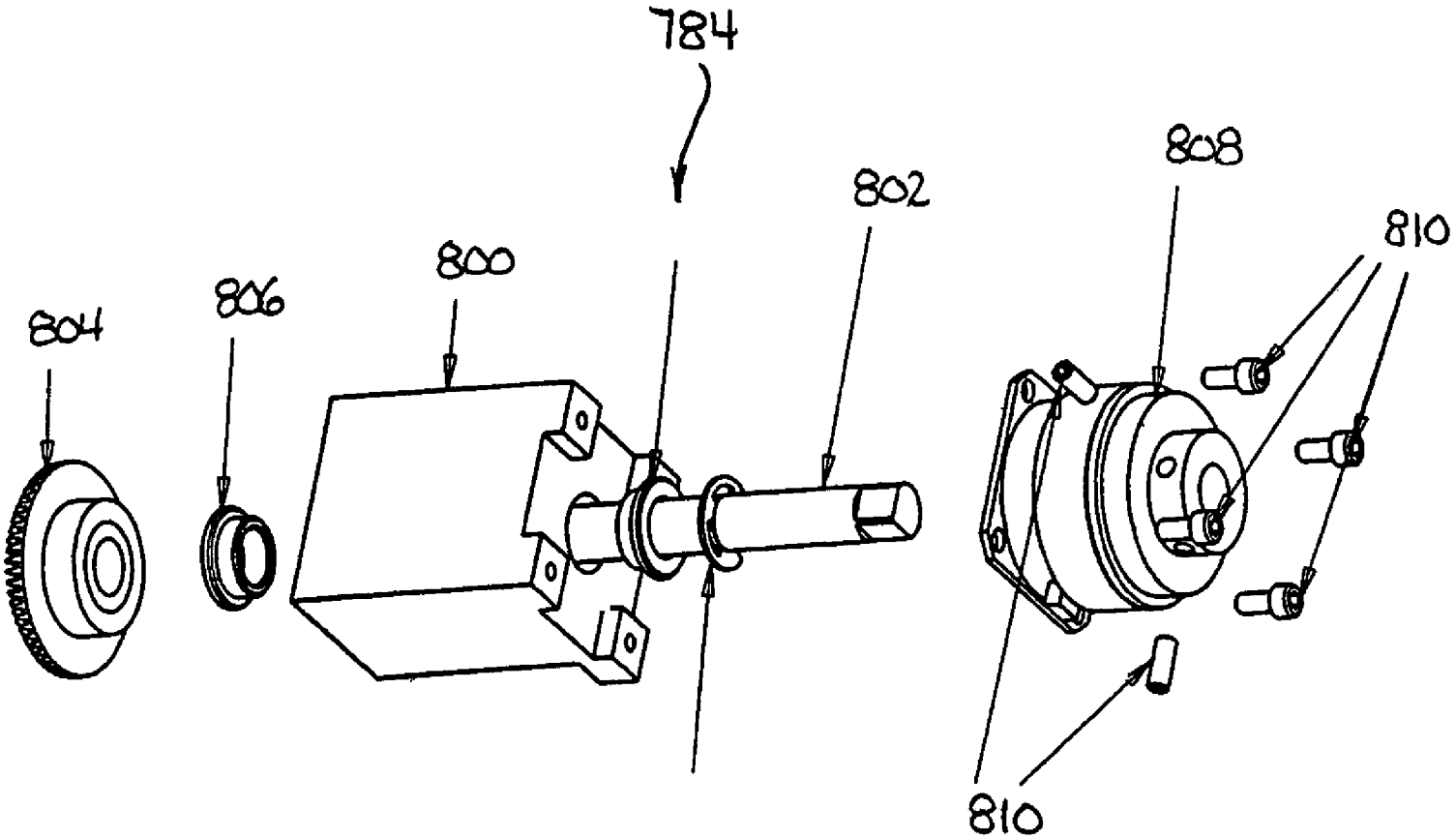
FIG. 23 is a side perspective view with parts separated of the brake assembly of the ribbon saver mechanism.
Figure 24:
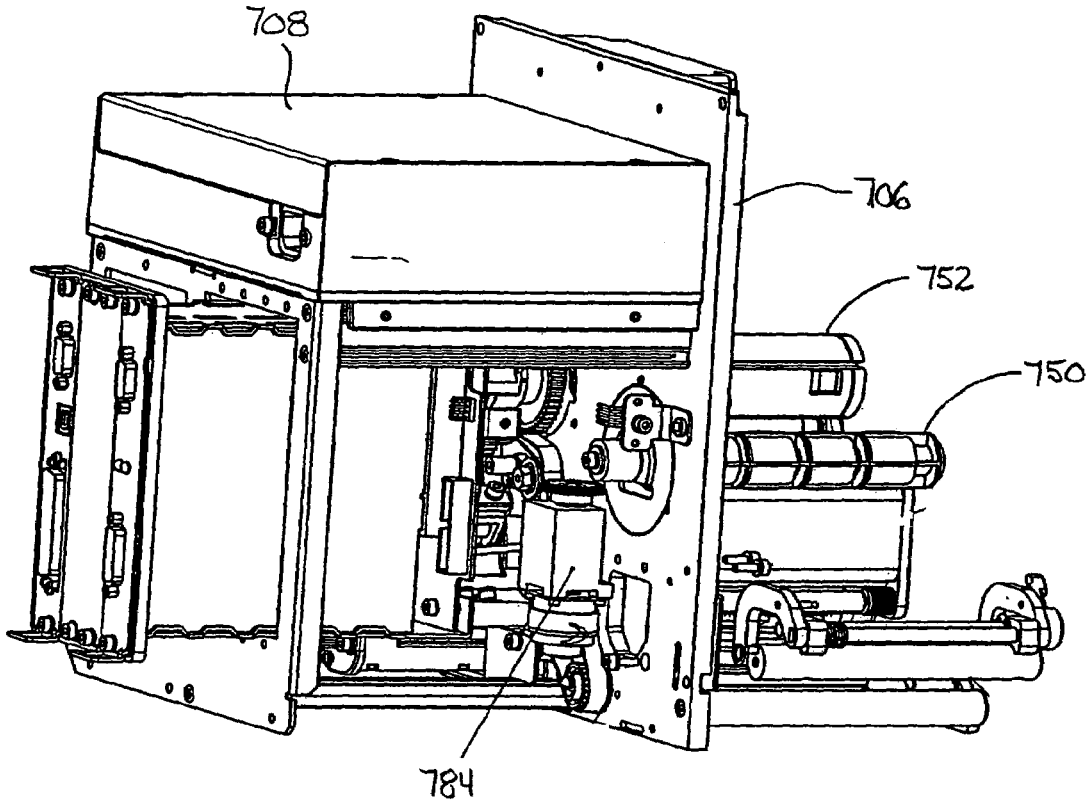
FIG. 24 is a side perspective view of the modular printer shown in FIG. 16 with the brake assembly of the ribbon saver mechanism secured thereto.

Referring to FIGS. 23 and 24, brake assembly 784 includes a mounting block 800 which is secured adjacent centerplate 706 on the electronics side of printer 700. A brake shaft 802 is rotatably positioned within a throughbore formed in mounting block 800. A bevel gear 804 and bearing 806 are secured to one end of shaft 802. An opposite end of shaft 802 extends through a brake 808. Brake 808 is preferably an electronically actuated brake although other known braking mechanisms may also be used. Brake 808 is secured to mounting block 800 with screws 810. Bevel gear 804 is positioned to engage a bevel gear (not shown) formed on an end of ribbon supply shaft 760 of ribbon supply assembly 750. Thus, rotation of ribbon supply shaft 760 effects rotation of bake shaft 802. When brake 808 is actuated, brake shaft 802 is prevented from rotating to prevent bevel gear 804 from rotating. Since bevel gear 804 is enmeshed with the bevel gear secured to ribbon supply shaft 760, ribbon supply shaft 760 is prevented from rotating and ribbon cannot be unwound from ribbon supply assembly 750.

In summary, when the ribbon saver mechanism is actuated, motor assembly 780 operates a cam assembly 782 to lift the printhead of the printhead assembly 716 away from the main platen roller 728 (FIG. 14), and brake 808 is actuated to prevent rotation of ribbon supply shaft 760. With the ribbon supply shaft locked and the printhead lifted, the label stock is fed through the printer independent of ribbon and no ribbon is consumed.

Printer engine 700 is similar in construction to modular printers 10 and 500 in that printer 700 includes a central support member 706 having printer modules supported on a first side of support member 706 and the electrical and drive components secured to an opposite side of support member 706. In addition to those components disclosed above, printer 700 includes at least two additional driven rollers to independently control movement of the media and ribbon within the printer. The rollers may be independently driven or driven by a common driver. The driven rollers include a drive roller or hub 728 for controlling movement of media and a second drive roller 732 for controlling movement of ribbon. Because drives are provided for the media and the ribbon, the ribbon need not be continuously driven through the printhead assembly with the media, but rather need only be driven through the printhead assembly when actual printing onto the media is occurring. As a result, a substantial reduction in the quantity of ribbon required to operate the printer is achieved. Software or control circuitry is provided to coordinate operation of the ink ribbon drive roller with operation of the printhead assembly.

It will be understood that various modifications may be made to the embodiments disclosed herein. For example, all of the components need not be configured as modules, i.e., only one or some of the components may be configured in module form. Therefore, the above description should not be construed as limiting, but merely as exemplifications of preferred embodiments. Those skilled in the art will envision other modifications within the scope and spirit of the claims appended hereto.

What is claimed is:

1. A printer comprising:

a rotatable supply assembly configured and adapted to store a quantity of a print medium;

a rotatable take-up assembly configured and adapted to receive the print medium;

a printhead assembly including a printhead;

a ribbon supply assembly including a hub assembly, said hub assembly configured and adapted for rotatably receiving a spool having a quantity of ribbon wherein rotation of the spool creates an amount of back tension in the ribbon;

a ribbon take-up assembly configured and adapted to receive the ribbon; and a first motor assembly operatively coupled to said rotatable take-up assembly and said ribbon take-up assembly.

2. The printer of claim 1, wherein the hub assembly further includes at least one hub portion and at least one spring, the at least on hub portion and the at least one spring being rotatably mounted on a shaft.

3. The printer of claim 2, wherein the at least one spring is a torsion spring.

4. The printer of claim 1, wherein the ribbon supply assembly further includes a sensor, the sensor communicating to circuitry in the printer the quantity of ribbon on the spool.

5. The printer of claim 1, wherein the ribbon supply assembly further includes a sensor, the sensor communicating to circuitry in the printer the rotational condition of the spool.

6. The printer of claim 1, wherein the amount of back tension in the ribbon is proportional to a width of the spool.

7. The printer of claim 1, further comprising a mechanism for feeding at least a portion of the print medium independent of the ribbon.

8. The printer of claim 7, wherein the mechanism includes a second motor assembly cooperative with a cam assembly for moving the printhead at a predetermined time thereby separating the printhead from the print medium.

9. The printer of claim 8, wherein the mechanism further includes a brake assembly configured to stop rotation of the ribbon supply assembly at the predetermined time.

10. A printer comprising:

a rotatable take-up assembly adapted and configured to receive a quantity of a printing medium;

a rotatable supply assembly;

a printhead assembly;

a motor assembly operatively coupled to said rotatable take-up assembly; and a media sensing assembly including a sensor and an indicator, said indicator being rotatable relative to said sensor, wherein the indicator includes alternating regions of at least two different reflectivities including alternating regions of black and silver.

11. The printer of claim 10, wherein the sensor is an infrared sensor.

12. The printer of claim 10, wherein the sensor produces an output signal, said output signal being communicated to associated circuitry in said printer.

13. The printer of claim 12, wherein said output signal includes information indicative of the quantity of media in said rotatable supply assembly.

14. The printer of claim 12, wherein said output signal includes information indicative of the rotation of said rotatable supply assembly.

* * * * *